US008409371B2

(12) United States Patent
Watanabe et al.

(10) Patent No.: US 8,409,371 B2
(45) Date of Patent: Apr. 2, 2013

(54) METHOD FOR PRODUCING SOFT MAGNETIC METAL POWDER COATED WITH MG-CONTAINING OXIDE FILM

(75) Inventors: Muneaki Watanabe, Kuki (JP); Ryoji Nakayama, Tokyo (JP); Gakuji Uozumi, Mito (JP)

(73) Assignee: Diamet Corporation, Niigata-Shi (JP)

( * ) Notice: Subject to any disclaimer, the term of this patent is extended or adjusted under 35 U.S.C. 154(b) by 0 days.

(21) Appl. No.: 13/227,359

(22) Filed: Sep. 7, 2011

(65) Prior Publication Data

US 2012/0070567 A1 Mar. 22, 2012

Related U.S. Application Data

(62) Division of application No. 11/574,655, filed as application No. PCT/JP2005/016348 on Sep. 6, 2005, now abandoned.

(30) Foreign Application Priority Data

| | | |
|---|---|---|
| Sep. 6, 2004 | (JP) | 2004-257841 |
| Feb. 1, 2005 | (JP) | 2005-025326 |
| Mar. 2, 2005 | (JP) | 2005-057195 |
| May 30, 2005 | (JP) | 2005-156561 |
| May 31, 2005 | (JP) | 2005-158894 |
| May 31, 2005 | (JP) | 2005-159770 |
| Aug. 9, 2005 | (JP) | 2005-231191 |

(51) Int. Cl.
*C23C 28/00* (2006.01)

(52) U.S. Cl. ..... 148/276; 252/62; 75/351

(58) Field of Classification Search ..... 148/276
See application file for complete search history.

(56) References Cited

U.S. PATENT DOCUMENTS

| | | | |
|---|---|---|---|
| 3,000,828 | A | 9/1961 | Buckley et al. |
| 6,399,146 | B1 | 6/2002 | Harris et al. |
| 6,689,183 | B2 | 2/2004 | Gay |

FOREIGN PATENT DOCUMENTS

| | | | |
|---|---|---|---|
| JP | 63-226011 | | 9/1988 |
| JP | 06-306600 | | 11/1994 |
| JP | 08-167519 | | 6/1996 |
| JP | 09-003502 | | 1/1997 |
| JP | 09-180924 | A | 7/1997 |
| JP | A-11-001702 | | 1/1999 |
| JP | 11-144932 | A | 5/1999 |
| JP | 2001-254168 | A | 9/2001 |
| JP | 2003-142310 | | 5/2003 |
| JP | 2003-217919 | A | 7/2003 |
| JP | T-2003-522298 | | 7/2003 |
| JP | 2004-297036 | | 10/2004 |
| WO | WO 01/58624 | A1 | 8/2001 |

OTHER PUBLICATIONS

Japanese Office Action mailed on Jun. 10, 2010 for the counterpart Japanese application No. 2005-057195.

J.A. Bas et al., "Sintered soft magnetic materials, Properties and applications." Journal of Magnetism and Magnetic Materials 254-255 (2003) 391-398.

International Search Report dated Dec. 13, 2005, which Issued during the prosecution of International Patent Application No. PCT/JP2005/016348.

European Search Report mailed Jun. 2, 2009 for the related European Application No. 05782230.6.

*Primary Examiner* — Roy King
*Assistant Examiner* — Christopher Kessler
(74) *Attorney, Agent, or Firm* — Leason Ellis LLP.

(57) ABSTRACT

A method for producing a soft magnetic metal powder coated with a Mg-containing oxide film, comprising the steps of adding and mixing a Mg powder with a soft magnetic metal powder which has been subjected to heating treatment in an oxidizing atmosphere at a temperature of 40 to 500° C. to obtain a mixed powder, and heating the mixed powder at a temperature of 150 to 1,100° C. in an inert gas or vacuum atmosphere under a pressure of $1\times10^{-12}$ to $1\times10^{-1}$ MPa, while optionally tumbling; and a method for producing a composite soft magnetic material from the soft magnetic metal powder coated with a Mg-containing oxide film.

6 Claims, 3 Drawing Sheets

METHOD FOR PRODUCING SOFT MAGNETIC METAL POWDER COATED WITH MG-CONTAINING OXIDE FILM

CROSS REFERENCE TO PRIOR APPLICATIONS

This application is a Divisional of U.S. patent application Ser. No. 11/574,655, filed Mar. 2, 2007 (now abandoned), which is a U.S. National Phase Application under 35 U.S.C. §371 of International Patent Application No. PCT/JP2005/016348 filed Sep. 6, 2005, and claims the benefit of Japanese Patent Applications No. 2004-257841, filed Sep. 6, 2004; No. 2005-025326, filed Feb. 1, 2005; No 2005-057195, filed Mar. 2, 2005; No. 2005-156561, filed May 30, 2005; No. 2005-159770, filed May 31, 2005; No. 2005-158894, filed May 31, 2005 and No. 2005-231191, filed Aug. 9, 2005, all of which are incorporated by reference herein. The International Application was published in Japanese on Mar. 16, 2006 as WO 2006/028100 A1 under PCT Article 21(2).

TECHNICAL FIELD

The present invention relates to a method for producing a soft magnetic metal powder coated with a Mg-containing oxide film, and a method for producing a composite soft magnetic material using the soft magnetic metal powder coated with the Mg-containing oxide film The composite soft magnetic material is used, for example, as a raw material for various electromagnet circuit components, such as a magnetic core, motor core, generator core, solenoid core, ignition core, reactor core, transcore, choke coil core and magnetic sensor core.

Further, the present invention relates to a raw powder material for producing a soft magnetic metal powder coated with the Mg-containing oxide film.

BACKGROUND ART

Conventionally, it is known that soft magnetic materials used for various electromagnet circuit components, such as a magnetic core, motor core, generator core, solenoid core, ignition core, reactor core, transcore, choke coil core and magnetic sensor core are required to have low iron loss, and thus, required to have high electric resistance and low coercivity. Further, in recent years, miniaturization and high response have been a requirement in electromagnetic circuits. Therefore, an improvement of magnetic flux density is also of related importance.

As an example of a magnetic core consisting of such a soft magnetic material, a laminate steel plate is known which is obtained by coating and laminating an insulating layer consisting of MgO on a surface of a soft magnetic metal plate (see Patent Document 1). However, although this steel plate is satisfactory in both of magnetic flux density and electric resistance, it is difficult to produce an electromagnetic component having a complex shape from such a steel plate. For producing an electromagnetic component having a complex shape, a method is known in which a surface of a soft magnetic metal powder is coated with a MgO insulating film by a wet method such as chemical plating or coating to obtain a composite soft magnetic metal powder, and the thus obtained composite soft magnetic metal powder is subjected to press molding, followed by sintering. Further, a method is known in which a soft magnetic metal powder is mixed with a Mg ferrite powder and subjected to press molding, followed by sintering, to thereby obtain a sintered, composite soft magnetic material having MgO as an insulating layer.

As the soft magnetic metal powder, an iron powder, an insulated-iron powder, an Fe—Al iron-based soft magnetic alloy powder, Fe—Ni iron-based soft magnetic alloy powder, Fe—Cr iron-based soft magnetic alloy powder, Fe—Si iron-based soft magnetic alloy powder, Fe—Si—Al iron-based soft magnetic alloy powder, Fe—Co iron-based soft magnetic alloy powder, Fe—Co—V iron-based soft magnetic alloy powder, or Fe—P iron-based soft magnetic alloy powder is generally known.

Patent Document 1: Japanese Unexamined Patent Application, First Publication No. 63-226011

Furthermore, as a soft magnetic material for use in various electromagnetic components, a composite magnetic material is proposed in which a substance having high resistivity is provided between iron powder particles. For example, a method for producing a compacted-powder magnetic core is known in which a mixture of an iron powder, a $SiO_2$-forming compound, and $MgCO_3$ or MgO is subjected to powder compaction to obtain a shaped article, and the obtained shaped article is maintained at a temperature of 500 to 1,100° C., thereby forming a glass phase containing $SiO_2$ and MgO as main components between iron powder particles to provide insulation between iron powder particles (see Patent Document 1).

Patent Document 1: Japanese Unexamined Patent Application, First Publication No. 2003-217919

DISCLOSURE OF THE INVENTION

However, the above-mentioned method for producing a composite soft magnetic metal powder in which a surface of a soft magnetic material is coated with a MgO insulating film by a wet method such as chemical plating or coating has disadvantages in that the method is costly and mass production is difficult, and that, hence, a composite soft magnetic metal powder produced by this method is expensive, and a composite soft magnetic material produced therefrom is also expensive. Further, in a composite soft magnetic metal powder produced by this method, the MgO insulating film is more stable than the soft magnetic metal powder, so that a diffusion reaction hardly occurs between the MgO insulating film and the surface of the soft magnetic metal powder. As a result, the adhesion of the formed MgO insulating film to the surface of the soft magnetic metal powder becomes insufficient. Therefore, when this composite soft magnetic metal powder produced by a wet method is subjected to press molding, the MgO insulating film is broken, so that a satisfactory insulation effect cannot be achieved, and hence, a composite soft magnetic material produced from this composite soft magnetic metal powder cannot exhibit a satisfactorily high resistance.

On the other hand, the above-mentioned method in which an insulative Mg ferrite powder is added and mixed with a soft magnetic metal powder, followed by pressing and sintering is advantageous in that the production cost is low, so that a composite soft magnetic material can be provided at a low cost. However, the composite soft magnetic material obtained by this method is disadvantageous in that it possesses a microstructure in which MgO is biasedly dispersed at triple junctions of three grain boundaries of soft magnetic metal particles, and MgO is not homogeneously dispersed in grain boundaries, and hence, the composite soft magnetic material exhibits a low resistivity.

Further, with respect to conventional composite soft magnetic, sintered materials, among the properties of density, flexural strength, resistivity and magnetic flux density, resistivity is especially unsatisfactory. Therefore, a composite soft magnetic, sintered material having a higher resistivity has been desired.

In this situation, the present inventors have performed extensive and intensive studies with a view toward solving the above-mentioned problems. As a result, they found the following.

(a) A soft magnetic metal powder coated with a Mg-containing oxide film, namely, a soft magnetic metal powder having a Mg-containing oxide insulating film on the surface thereof can be obtained by subjecting a soft magnetic metal powder to oxidation treatment to provide a raw powder material; adding and mixing a Mg powder to the raw powder material to obtain a mixed powder; heating the mixed powder at a temperature of 150 to 1,100° C. in an inert gas or vacuum atmosphere under a pressure of $1\times10^{-12}$ to $1\times10^{-1}$ MPa; and optionally heating the resultant product in an oxidizing atmosphere at a temperature of 50 to 400° C. This soft magnetic metal powder coated with a Mg-containing oxide film has excellent adhesion properties as compared to a conventional soft magnetic metal powder coated with a Mg ferrite film as the Mg-containing oxide film, so that it can be subjected to press molding to obtain a compacted powder article with reduced occurrence of breaking and delaminating of the insulating film Further, by sintering the thus obtained compacted powder article at a temperature of 400 to 1,300° C., there can be obtained a composite soft magnetic material having a microstructure in which MgO is homogeneously dispersed in grain boundaries, and MgO is not biasedly dispersed at triple junctions of three grain boundaries of soft magnetic metal particles.

(b) In a method including subjecting a soft magnetic metal to oxidation treatment to provide a raw powder material, adding and mixing an Mg powder with the raw powder material to obtain a mixed powder, and heating the mixed powder at a temperature of 150 to 1,100° C. in an inert or vacuum atmosphere under a pressure of $1\times10^{-12}$ to $1\times10^{-1}$ MPa, it is preferable to perform the heating of the mixed powder while tumbling the mixed powder.

(c) As the soft magnetic metal powder, any one of those conventionally known can be used, such as an iron powder, an insulated-iron powder, Fe—Al iron-based soft magnetic alloy powder, Fe—Ni iron-based soft magnetic alloy powder, Fe—Cr iron-based soft magnetic alloy powder, Fe—Si iron-based soft magnetic alloy powder, Fe—Si—Al iron-based soft magnetic alloy powder, Fe—Co iron-based soft magnetic alloy powder, Fe—Co—V iron-based soft magnetic alloy powder, or Fe—P iron-based soft magnetic alloy powder.

(d) A soft magnetic metal powder coated with a Mg—Si-containing oxide film, namely, a soft magnetic metal powder having a Mg—Si-containing oxide film formed on the surface thereof can be obtained by maintaining a soft magnetic powder in an oxidizing atmosphere at a temperature of room temperature to 500° C. to provide a soft magnetic powder coated with an oxide; adding and mixing a silicon monoxide powder with the soft magnetic powder coated with an oxide; performing heating in a vacuum atmosphere at a temperature of 600 to 1,200° C. during or following the mixing of a silicon monoxide powder with the soft magnetic powder; adding and mixing a Mg powder with the resultant; and performing heating in a vacuum atmosphere at a temperature of 400 to 800° C. during or following the mixing of a Mg powder with the resultant. A composite soft magnetic, sintered material produced from this soft magnetic metal powder coated with a Mg—Si-containing oxide film has excellent properties with respect to density, flexural strength, resistivity and magnetic flux density, as compared to a conventional composite soft magnetic, sintered material obtained by subjecting a mixture of a $SiO_2$-forming compound and $MgCO_3$ or MgO to compression molding, followed by sintering.

(e) A soft magnetic metal powder coated with a Mg—Si-containing oxide film, namely, a soft magnetic metal powder having a Mg—Si-containing oxide film formed on the surface thereof can be obtained by maintaining a soft magnetic powder in an oxidizing atmosphere at a temperature of room temperature to 500° C. to provide a soft magnetic powder coated with an oxide; adding and mixing a silicon monoxide powder and a Mg powder with the soft magnetic powder coated with an oxide; and performing heating in a vacuum atmosphere at a temperature of 400 to 1,200° C. during or following the mixing of a silicon monoxide powder and a Mg powder with the soft magnetic powder coated with an oxide. A composite soft magnetic, sintered material produced from this soft magnetic metal powder coated with a Mg—Si-containing oxide film has excellent properties with respect to density, flexural strength, resistivity and magnetic flux density, as compared to a conventional composite soft magnetic, sintered material obtained by subjecting a mixture of a $SiO_2$-forming compound and $MgCO_3$ or MgO to compression molding, followed by sintering.

(f) A soft magnetic metal powder coated with a Mg-containing oxide film, namely, a soft magnetic metal powder having a Mg-containing oxide film formed on the surface thereof can be obtained by maintaining a soft magnetic powder in an oxidizing atmosphere at a temperature of room temperature to 500° C. to provide a soft magnetic powder coated with an oxide; adding and mixing a Mg powder with the soft magnetic powder coated with an oxide; and performing heating in a vacuum atmosphere at a temperature of 400 to 800° C. during or following the mixing of a Mg powder with the soft magnetic powder coated with an oxide. Further, a soft magnetic metal powder coated with a Mg—Si-containing oxide film, namely, a soft magnetic metal powder having a Mg—Si-containing oxide film formed on the surface thereof can be obtained by adding and mixing a silicon monoxide powder with the soft magnetic powder coated with a Mg-containing oxide film; and performing heating in a vacuum atmosphere at a temperature of 600 to 1,200° C. during or following the mixing of a silicon monoxide powder with the soft magnetic powder coated with a Mg-containing oxide film. A composite soft magnetic, sintered material produced from this soft magnetic metal powder coated with a Mg—Si-containing oxide film has excellent properties with respect to density, flexural strength, resistivity and magnetic flux density, as compared to a conventional composite soft magnetic, sintered material obtained by subjecting a mixture of a $SiO_2$-forming compound and $MgCO_3$ or MgO to compression molding, followed by sintering.

(g) The silicon monoxide is added preferably in an amount of 0.01 to 1% by mass, and the Mg powder is added preferably in an amount of 0.05 to 1% by mass.

(h) The vacuum atmosphere is preferably an atmosphere under a pressure of $1\times10^{-12}$ to $1\times10^{-1}$ MPa.

The present invention has been completed based on these findings. Accordingly, the present invention provides:

(1) a method for producing a soft magnetic metal powder coated with an Mg-containing oxide film, including the steps of: subjecting a soft magnetic metal powder to oxidation treatment to provide a raw powder material; adding and mixing a Mg powder with the raw powder material to obtain a mixed powder; and heating the mixed powder at a temperature of 150 to 1,100° C. in an inert gas or vacuum atmosphere under a pressure of $1\times10^{-12}$ to $1\times10^{-1}$ MPa, thereby obtaining a soft magnetic metal powder coated with a Mg-containing oxide film;

(2) the method according to item (1) above, further including the step of heating the soft magnetic metal powder coated with a Mg-containing oxide film in an oxidizing atmosphere at a temperature of 50 to 400° C.;

(3) the method according to item (1) above, wherein the step of subjecting a soft magnetic metal powder to oxidation treatment includes heating a soft magnetic metal powder in an oxidizing atmosphere at a temperature of 50 to 500° C.;

(4) a raw powder material for producing a soft magnetic metal powder coated with a Mg-containing oxide film, provided by subjecting a soft magnetic metal powder to oxidation treatment;

(5) a method for producing a soft magnetic metal powder coated with a Mg-containing oxide film, including the steps of: adding and mixing a Mg powder with a soft magnetic metal powder to obtain a mixed powder; and heating the mixed powder at a temperature of 150 to 1,100° C. in an inert gas or vacuum atmosphere under a pressure of $1\times10^{-12}$ to $1\times10^{-1}$ MPa, followed by heating in an oxidizing atmosphere at a temperature of 50 to 400° C. to effect oxidation treatment, thereby obtaining a soft magnetic metal powder coated with a Mg-containing oxide film;

(6) a method for producing a soft magnetic powder coated with a Mg—Si-containing oxide film, including the steps of: forming an oxide film on a surface of a soft magnetic powder to provide an oxide-coated soft magnetic powder; adding and mixing a silicon monoxide powder with the oxide-coated soft magnetic powder; performing heating in a vacuum atmosphere at a temperature of 600 to 1,200° C. during or following the mixing of a silicon monoxide powder with the oxide-coated soft magnetic powder; adding and mixing a Mg powder with the resultant; and performing heating in a vacuum atmosphere at a temperature of 400 to 800° C. during or following the mixing of a Mg powder with the resultant;

(7) a method for producing a soft magnetic powder coated with a Mg—Si-containing oxide film, including the steps of: forming an oxide film on a surface of a soft magnetic powder to provide an oxide-coated soft magnetic powder; adding and mixing a silicon monoxide powder and a MgO powder with the oxide-coated soft magnetic powder; and performing heating in a vacuum atmosphere at a temperature of 400 to 1,200° C. during or following the mixing of a silicon monoxide powder and a Mg powder with the oxide-coated soft magnetic powder;

(8) a method for producing a soft magnetic powder coated with a Mg—Si-containing oxide film, including the steps of: forming an oxide film on a surface of a soft magnetic powder to provide an oxide-coated soft magnetic powder; adding and mixing an Mg powder with the oxide-coated soft magnetic powder; performing heating in a vacuum atmosphere at a temperature of 400 to 800° C. during or following the mixing of a Mg powder with the oxide-coated soft magnetic powder; adding and mixing a silicon monoxide powder with the resultant; and performing heating in a vacuum atmosphere at a temperature of 600 to 1,200° C. during or following the mixing of a silicon monoxide powder with the resultant;

(9) the method according to any one of items (6) to (8) above, wherein the step of forming an oxide film on a surface of a soft magnetic powder includes heating a soft magnetic powder in an oxidizing atmosphere at a temperature of room temperature to 500° C.;

(10) the method according to any one of items (6) to (9) above, wherein the silicon monoxide is added in an amount of 0.01 to 1% by mass, and the Mg powder is added in an amount of 0.05 to 1% by mass; and

(11) the method according to any one of items (6) to (10) above, wherein the vacuum atmosphere is an atmosphere under a pressure of $1\times10^{-12}$ to $1\times10^{-1}$ MPa.

Among silicon oxides, silicon monoxide (SiO) has the highest vapor pressure, so it can easily deposit a silicon oxide component on a surface of a soft magnetic powder by heating. Therefore, it is not preferable to mix silicon dioxide ($SiO_2$) having a low vapor pressure with silicon monoxide because a silicon oxide film having a satisfactory thickness cannot be formed on a surface of a soft magnetic powder by heating. By adding and mixing a silicon monoxide powder with an oxide-coated soft magnetic powder, and performing heating in a vacuum atmosphere at a temperature of 600 to 1,200° C. during or following the mixing, a soft magnetic powder coated with a silicon oxide film, namely, a soft magnetic powder having a SiO, film (wherein x=1 or 2) formed on the surface thereof can be produced. Further, by adding and mixing a Mg powder with this soft magnetic powder coated with a silicon oxide film while heating in a vacuum atmosphere, a soft magnetic powder coated with a Mg—Si-containing oxide including Mg—Si—Fe—O can be obtained.

The oxide-coated soft magnetic powder can be produced by heating a soft magnetic powder in an oxidizing atmosphere (e.g., air) at a temperature of room temperature to 500° C., thereby forming an iron oxide film on a surface of the soft magnetic powder. This iron oxide film has the effect of improving the coatability of SiO and/or Mg. In the production of the oxide-coated soft magnetic powder, when the heating in an oxidizing atmosphere is performed at a temperature higher than 500° C., disadvantages are caused in that particles of the soft magnetic powder agglomerate to form an aggregate which is sintered, such that a homogeneous surface oxidation cannot be achieved. For this reason, the heating temperature in the production of an oxide-coated soft magnetic powder is set in the range of room temperature to 500° C. The heating temperature is more preferably in the range of room temperature to 300° C. The oxidizing atmosphere is preferably a dry oxidizing atmosphere.

In the method for producing a soft magnetic powder coated with a Mg—Si-containing oxide film according to the present invention, the reasons for limiting the amount of SiO powder added to the oxide-coated soft magnetic powder in the range of 0.01 to 1% by mass are as follows. When the amount of SiO added is less than 0.01% by mass, the thickness of the silicon oxide film formed on a surface of the oxide-coated soft magnetic powder becomes unsatisfactory, so that the amount of Si in the Mg—Si-containing oxide film becomes unsatisfactory, thereby causing a disadvantage in that a Mg—Si-containing oxide film having high resistivity cannot be obtained. On the other hand, when the amount of SiO added is more than 1% by mass, the thickness of the silicon oxide film ($SiO_x$ film (x=1 or 2)) becomes too large, thereby causing a disadvantage in that the density of a composite soft magnetic material obtained by subjecting the soft magnetic powder coated with a Mg—Si-containing oxide film to powder compaction and sintering is lowered.

Further, in the method for producing a soft magnetic powder coated with a Mg—Si-containing oxide film according to the present invention, the reasons for limiting the amount of Mg powder added to the oxide-coated soft magnetic powder in the range of 0.05 to 1% by mass are as follows. When the amount of Mg added is less than 0.05% by mass, the thickness of the Mg film formed on a surface of the oxide-coated soft magnetic film becomes unsatisfactory, thereby causing a disadvantage in that the amount of Mg in the Mg—Si-containing oxide film becomes unsatisfactory, and hence, a Mg—Si-containing oxide film having a satisfactory thickness cannot be obtained. On the other hand, when the amount of Mg added is more than 1% by mass, the thickness of the Mg film becomes too large, thereby causing a disadvantage in that the density of a composite soft magnetic material obtained by subjecting the soft magnetic powder coated with a Mg—Si-containing oxide film to powder compaction and sintering is lowered.

In the method for producing a soft magnetic powder coated with a Mg—Si-containing oxide film according to the present invention, the reasons for setting the conditions for adding and mixing a SiO powder, a Mg powder, or a mixed powder of SiO and Mg with an oxide-coated soft magnetic powder as a vacuum atmosphere at a temperature of 600 to 1,200° C. are as follows. When the heating is performed at a temperature lower than 600° C., the vapor pressure of SiO is too low, so that a SiO film or Mg—Si-containing oxide film having a satisfactory thickness cannot be obtained. On the other hand, when the heating is performed at a temperature higher than 1,200° C., the soft magnetic powder is sintered, so that a desired soft magnetic powder coated with a Mg—Si-containing oxide cannot be obtained. The heating is preferably performed in a vacuum atmosphere under a pressure of $1\times10^{-12}$ to $1\times10^{-1}$ MPa, more preferably while tumbling.

As the soft magnetic powder for producing an oxide-coated soft magnetic powder, it is preferable to use a soft magnetic powder having an average particle diameter in the range of 5 to 500 μm. The reasons for this are as follows. When the average particle diameter is smaller than 5 μm, the compressibility of the powder becomes low, so that the volume ratio of the soft magnetic powder becomes low, and the magnetic flux density becomes low. On the other hand, when the average particle diameter is larger than 500 μm, the eddy current generated in the soft magnetic powder increases, and the magnetic permeability becomes low at high frequencies.

In the method for producing a soft magnetic powder coated with a Mg—Si-containing oxide film according to the present invention, it is necessary to use an oxide-coated soft magnetic powder as a raw powder material, which is obtained by forming an iron oxide film on a surface of a soft magnetic powder. Accordingly, the present invention also provides:

(12) a raw powder material for producing a soft magnetic powder coated with a Mg—Si-containing oxide film, including an oxide-coated soft magnetic powder obtained by forming an oxide film on a surface of a soft magnetic powder.

(13) The method according to any one of items (1), (5), (6), (7), (8) or (9) above, wherein the heating in a vacuum or inert gas atmosphere is performed while tumbling.

In the method for producing a soft magnetic metal powder coated with a Mg-containing oxide film according to the present invention, a soft magnetic metal powder which has been subjected to oxidation treatment is used as a raw powder material. Accordingly, the present invention also provides:

(14) a raw powder material defined in item (6) above for producing a soft magnetic powder coated with a Mg-containing oxide film, wherein the soft magnetic metal powder is an iron powder, an insulated-iron powder, Fe—Al iron-based soft magnetic alloy powder, Fe—Ni iron-based soft magnetic alloy powder, Fe—Cr iron-based soft magnetic alloy powder, Fe—Si iron-based soft magnetic alloy powder, Fe—Si—Al iron-based soft magnetic alloy powder, Fe—Co iron-based soft magnetic alloy powder, Fe—Co—V iron-based soft magnetic alloy powder, or Fe—P iron-based soft magnetic alloy powder.

(15) A method for producing a raw powder material including a soft magnetic powder which has been subjected to oxidation treatment, which includes the steps of: adding and mixing a Si powder with an Fe—Si iron-based soft magnetic powder or Fe powder, followed by heating in a non-oxidizing atmosphere to obtain an Fe—Si iron-based soft magnetic powder having a high-concentration Si diffusion layer which has a Si concentration higher than the Fe—Si iron-based soft magnetic powder or Fe powder; and subjecting the Fe—Si iron-based soft magnetic powder having a high-concentration Si diffusion layer to oxidizing treatment, thereby obtaining a surface-oxidized, Fe—Si iron-based soft magnetic raw powder material having an oxide layer formed on the high-concentration Si diffusion layer.

By using a soft magnetic metal powder coated with a Mg-containing oxide film which is produced by the method of any one of items (1), (5), (7), (8) and (9) above, a composite soft magnetic material having excellent resistivity and mechanical strength can be produced. Accordingly, the present invention also provides:

(16) a method for producing a composite soft magnetic material having excellent resistivity and mechanical strength, including the steps of: subjecting a soft magnetic metal powder coated with a Mg-containing oxide film produced by the method of any one of items (1), (5), (6), (7), (8) and (9) above to press molding; and sintering the resultant at a temperature of 400 to 1,300° C.; and

(17) a method for producing a composite soft magnetic material having excellent resistivity and mechanical strength, including the steps of: mixing an organic insulating material, inorganic insulating material or a mixed material of an organic insulating material and an inorganic insulating material with a soft magnetic metal powder coated with a Mg-containing oxide film produced by the method of any one of items (1), (5), (6), (7), (8) and (9) above, followed by powder compaction; and sintering the resultant at a temperature of 500 to 1,000° C.

In the method for producing a soft magnetic metal powder coated with a Mg-containing oxide film according to the present invention, for producing a mixed powder by adding and mixing a Mg powder with a soft magnetic metal powder which has been subjected to oxidation treatment, it is preferable to add the Mg powder in an amount of 0.05 to 2% by mass, based on the mass of the soft magnetic metal powder which has been subjected to oxidation treatment. When the amount of Mg powder added is less than 0.05% by mass, based on the mass of the soft magnetic metal powder, the amount of Mg coating formed is unsatisfactory, so that a Mg-containing oxide film having sufficient thickness cannot be obtained. On the other hand, when the Mg powder is added in an amount of more than 2% by mass, the thickness of the Mg coating becomes too large, so that the thickness of the Mg-containing oxide film becomes too large, thereby causing a disadvantage in that the magnetic flux density of a composite soft magnetic material obtained by subjecting the soft magnetic powder coated with a Mg-containing oxide film to powder compaction and sintering is lowered.

The oxidization treatment of a soft magnetic metal powder has the effect of improving the coatability of Mg, and is performed by maintaining the treatment in an oxidizing atmosphere at a temperature of 50 to 500° C., or maintaining the treatment in distilled water or pure water at a temperature of 50 to 100° C. In either case, the oxidization treatment is not effective when the temperature is lower than 50° C. On the other hand, when the oxidization treatment is performed by maintaining an oxidizing atmosphere at a temperature higher than 500° C., an unfavorable sintering occurs. The oxidizing atmosphere is preferably a dry oxidizing atmosphere.

FIG. 1 exemplifies various patterns of variation of temperature with time during oxidation treatment of a soft magnetic metal powder. Generally, oxidation treatment is performed by heating in an oxidizing atmosphere in a manner as shown by the pattern indicated in FIG. 1A. However, the oxidation treatment may also be performed in a manner as shown by the pattern indicated in FIG. 1B, in which the temperature is elevated to a relatively low temperature and maintained, and then the temperature is elevated to a higher temperature and maintained. Further, the oxidation treatment may also be performed in a manner as shown by the pattern indicated in FIG. 1C, in which the temperature is elevated to a relatively high temperature and maintained, and then the temperature is lowered to a lower temperature and maintained. Furthermore, the oxidation treatment may also be performed in a manner as shown by the pattern indicated in FIG. 1D, in which the temperature is elevated and lowered without substantially being maintained. Alternatively, when the oxidation treatment is performed in distilled water or pure water, any one of the patterns shown in FIGS. 1A to 1D may be used, wherein the upper and lower limits of the temperature range are 100° C. and 50° C., respectively. In the method for producing a soft magnetic metal powder coated with a Mg-containing oxide film according to the present invention, the patterns of variation of temperature with time during oxidation treatment of a soft magnetic metal powder are not limited to those shown in FIG. 1, and may be changed freely within the range of 50 to 500° C.

A Mg powder is added and mixed with a soft magnetic metal powder which has been subjected to oxidation treatment, and the resulting mixed powder is heated at a temperature of 150 to 1,100° C. in an inert gas or vacuum atmosphere under a pressure of $1\times10^{-12}$ to $1\times10^{-1}$ MPa, while optionally tumbling. The reason for defining the heating atmosphere as an inert gas or vacuum atmosphere under a pressure of $1\times10^{-12}$ to $1\times10^{-1}$ MPa is that such an atmosphere includes a high vacuum, inert gas atmosphere under a pressure of $1\times10^{-12}$ to $1\times10^{-1}$ MPa.

The reasons for setting the heating temperature in the range of 150 to 1,100° C. are as follows. When the temperature is lower than 150° C., it becomes necessary to adjust the pressure to lower than $1\times10^{-12}$ MPa, which is not only difficult from an industrial viewpoint, but is also not effective. On the other hand, when the temperature is higher than 1,100° C., loss of Mg increases disadvantageously. Further, when the pressure exceeds $1\times10^{-1}$ MPa, disadvantages are caused in that the coating efficiency of the Mg coating is lowered, and in that the thickness of the Mg coating formed becomes non-uniform. The heating temperature of the mixed powder of the soft magnetic metal powder and the Mg powder is more preferably in the range of 300 to 900° C., and the pressure is more preferably $1\times10^{-10}$ to $1\times10^{-2}$ MPa.

FIG. 2 exemplifies various; patterns of variation of temperature with time during heating of a soft magnetic metal powder which has been subjected to oxidation treatment, while optionally tumbling Generally, heating is performed by maintaining at a constant temperature as shown by the pattern indicated in FIG. 2A. However, the heating may also be performed in a manner as shown by the pattern indicated in FIG. 2B, in which the temperature is varied, or in a manner as shown by the pattern indicated in FIG. 2C, in which the temperature is elevated to a relatively low temperature and maintained, and then the temperature is elevated to a higher temperature and maintained, or in a manner 20 as shown by the pattern indicated in FIG. 2D, in which the temperature is elevated to a relatively high temperature and maintained, and then the temperature is lowered to a lower temperature and maintained. Further the heating may also be performed in a manner as shown by the pattern indicated in FIG. 2E, in which the pattern indicated in FIG. 2A is repeated a plurality of times. Furthermore, the heating may also be performed in a 25 manner as shown by the pattern indicated in FIG. 2F, in which the temperature is maintained at a high temperature, and then maintaining the temperature at a low temperature and then maintaining the temperature at a high temperature again.

In the method for producing a soft magnetic metal powder coated with a Mg-containing oxide film according to the present invention, the patterns of variation of temperature with time during heating of a soft magnetic metal powder which has been subjected to oxidation treatment, while optionally tumbling, are not limited to those shown in FIG. 2, and may be changed freely within the range of 150 to 1100° C.

Further, in another embodiment, a soft magnetic metal powder coated with an Mg-containing oxide film according to the present invention can be produced by adding and mixing a Mg powder with a soft magnetic metal powder to obtain a mixed powder, and heating the mixed powder at a temperature of 150 to 1,100° C. in an inert gas or vacuum atmosphere under a pressure of $1\times10^{-12}$ to $1\times10^{-1}$ MPa, while optionally tumbling, followed by heating in an oxidizing atmosphere at a temperature of 50 to 400° C. to effect oxidation treatment, thereby forming a Mg-containing oxide film on a surface of a soft magnetic metal powder. In this case, the oxidization treatment is not effective when the temperature is lower than 50° C. On the other hand, when the oxidization treatment is performed by maintaining in an oxidizing atmosphere at a temperature higher than 400° C., an unfavorable sintering occurs. The oxidizing atmosphere is preferably a dry oxidizing atmosphere.

FIG. 3 exemplifies various patterns of variation of temperature with time during oxidation treatment of the above-mentioned mixed powder. Generally, this oxidation treatment is performed by heating in an oxidizing atmosphere in a manner as shown by the pattern indicated in FIG. 3A. However, the oxidation treatment may also be performed in a manner as shown by the pattern indicated in FIG. 3B, in which the temperature is elevated to a relatively low temperature and maintained, and then the temperature is elevated to a higher temperature and maintained. Further, the oxidation treatment may also be performed in a manner as shown by the pattern indicated in FIG. 3C, in which the temperature is elevated to a relatively high temperature and maintained, and then the temperature is lowered to a lower temperature and maintained. Furthermore, the oxidation treatment may also be performed in a manner as shown by the pattern indicated in FIG. 3D, in which the temperature is elevated and lowered without substantially being maintained. The patterns of variation of temperature with time during the oxidation treatment of the above-mentioned mixed powder are not limited to those shown in FIG. 3, and may be changed freely within the range of 50 to 400° C.

By mixing the thus obtained soft magnetic metal powder which has been subjected to oxidation treatment under the above-mentioned conditions with a Mg powder to obtain a mixed powder, and heating the obtained mixed powder while tumbling, a Mg-containing oxide film is formed on a surface of the soft magnetic metal powder, thereby obtaining a soft magnetic metal powder coated with a Mg-containing oxide film Sometimes, however, the Mg oxidation may be insufficient. For preventing such insufficiency of Mg oxidation, it is preferable to subject the obtained soft magnetic metal powder coated with a Mg-containing oxide film to a further heating treatment at a temperature of 50 to 400° C. It is preferable that this heating be performed at a temperature of 50° C. or higher, but when the temperature exceeds 400° C., an unfavorable sintering occurs. For this reason, the temperature is set in the range of 50 to 400° C.

As the soft magnetic metal powder used as a raw material in the method for producing a soft magnetic metal powder coated with a Mg-containing oxide film according to the present invention, those which are conventionally known may be used, such as an iron powder, insulated-iron powder, Fe—Al iron-based soft magnetic alloy powder, Fe—Ni iron-based soft magnetic alloy powder, Fe—Cr iron-based soft magnetic alloy powder, Fe—Si iron-based soft magnetic alloy powder, Fe—Si—Al iron-based soft magnetic alloy powder, Fe—Co iron-based soft magnetic alloy powder, Fe—Co—V iron-based soft magnetic alloy powder, or Fe—P iron-based soft magnetic alloy powder. More specifically, the iron powder is preferably a pure iron powder, and the insulated-iron powder is preferably a phosphate-coated iron powder, or a silicon oxide- or aluminum oxide-coated iron powder which is obtained by adding and mixing a wet solution such as a silica sol-gel solution (silicate) or alumina sol-gel solution with an iron powder to coat the surface of the iron powder, followed by drying and sintering.

The Fe—Al iron-based soft magnetic alloy powder is preferably an Fe—Al iron-based soft magnetic alloy powder including 0.1 to 20% of Al and the remainder containing Fe and inevitable impurities (e.g., an Alperm powder having a composition including Fe-15% Al).

The Fe—Ni iron-based soft magnetic alloy powder is preferably a nickel-based soft magnetic alloy powder including 35 to 85% of nickel, optionally at least one member selected from the group including not more than 5% of Mo, not more than 5% of Cu, not more than 2% of Cr, and not more than 0.5% of Mn, and the remainder containing Fe and inevitable impurities. The Fe—Cr iron-based soft magnetic alloy powder is preferably an Fe—Cr iron-based soft magnetic alloy powder including 1 to 20% of Cr, optionally at least one member selected from the group consisting of not more than 5% of Al and not more than 5% of Ni, and the remainder containing Fe and inevitable impurities.

The Fe—Si iron-based soft magnetic alloy powder is preferably an Fe—Si iron-based soft magnetic alloy powder including 0.1 to 10% by weight of Si and the remainder containing Fe and inevitable impurities. The Fe—Si—Al iron-based soft magnetic alloy powder is preferably an Fe—Si—Al iron-based soft magnetic alloy powder including 0.1 to 10% by weight of Si, 0.1 to 20% of Al, and the remainder containing Fe and inevitable impurities. The Fe—Co—V iron-based soft magnetic alloy powder is preferably an Fe—Co—V iron-based soft magnetic alloy powder including 0.1 to 52% of Co, 0.1 to 3% of V, and the remainder containing Fe and inevitable impurities.

The Fe—Co iron-based soft magnetic alloy powder is preferably an Fe—Co iron-based soft magnetic alloy powder including 0.1 to 52% of Co, and the remainder containing Fe and inevitable impurities. The Fe—P iron-based soft magnetic alloy powder is preferably an Fe—P iron-based soft magnetic alloy powder including 0.5 to 1% of P, and the remainder containing Fe and inevitable impurities. (Hereinabove, "%" indicates "% by mass".)

Further, the above-mentioned soft magnetic metal powder preferably has an average particle diameter in the range of 5 to 500 μm. The reason for this is as follows. When the average particle diameter is less than 5 μm, the compressibility of the powder is lowered, and the volume ratio of the soft magnetic metal powder becomes smaller, thereby leading to lowering of the magnetic flux density value. On the other hand, when the average particle diameter is more than 500 μm, the eddy current generated in the soft magnetic powder increases, thereby lowering the magnetic permeability at high frequencies.

For producing a composite soft magnetic material from a soft magnetic metal powder coated with a Mg-containing oxide film produced by the method of the present invention, a soft magnetic metal powder coated with a Mg-containing oxide film produced by the method of the present invention is subjected to powder compaction and sintering by a conventional method. More specifically, at least one member selected from the group including silicon oxide and aluminum oxide, each having an average particle diameter of not more than 0.5 μm, is added and mixed with the soft magnetic metal powder coated with an Mg-containing oxide film to obtain a mixed powder including 0.05 to 1% by mass of the at least one and the remainder containing the soft magnetic metal powder coated with a Mg-containing oxide film, and the mixed powder is subjected to powder compaction and sintering by a conventional method.

A soft magnetic metal powder coated with a Mg-containing oxide film produced by the method of the present invention has a Mg-containing oxide film formed on the surface of the soft magnetic powder. The Mg-containing oxide film reacts with silicon oxide and/or aluminum oxide to form a composite oxide, thereby enabling the production of a composite soft magnetic material having high resistivity and mechanical strength, wherein the high resistivity is due to the presence of the high-resistivity composite oxide between grain boundaries of the soft magnetic powder, and the high mechanical strength is attained by sintering through silicon oxide and/or aluminum oxide. In this case, silicon oxide and/or aluminum oxide is mainly sintered, so that a low coercivity can be maintained, thereby enabling the production of a composite soft magnetic material with small hysteresis loss. The above-mentioned sintering is preferably performed in an inert gas or oxidizing gas atmosphere at a temperature of 400 to 1,300° C.

Further, a composite soft magnetic material may also be produced by adding and mixing a wet solution such as a silica sol-gel solution (silicate) or alumina sol-gel solution with a soft magnetic metal powder coated with a Mg-containing oxide film according to the present invention, followed by drying, subjecting the resulting dried mixture to compression molding, and sintering the resultant in an inert gas or oxidizing gas atmosphere at a temperature of 400 to 1,300° C.

In addition, a composite soft magnetic powder having improved properties with respect to resistivity and strength can be produced by mixing an organic insulating material, an inorganic insulating material, or a mixed material of an organic insulating material and an inorganic insulating material with a soft magnetic metal powder coated with a Mg-containing oxide film produced by the method of the present invention. In this case, as the organic insulating material, an epoxy resin, fluorine resin, phenol resin, urethane resin, silicone resin, polyester resin, phenoxy resin, urea resin, isocyanate resin, acrylic resin, polyimide resin, or PPS resin, can be used. As the inorganic insulating material, a phosphate such as iron phosphate, various glass insulating materials, water glass containing sodium silicate as a main component, or insulative oxide can be used.

Alternatively, a composite soft magnetic material can be obtained by adding and mixing, with a soft magnetic metal powder coated with a Mg-containing oxide film produced by the method of the present invention, at least one selected from the group including boron oxide, vanadium oxide, bismuth oxide, antimony oxide and molybdenum oxide in an amount of 0.05 to 1% by mass, in terms of $B_2O_3$, $V_2O_5$, $Bi_2O_3$, $Sb_2O_3$, $MoO_3$, followed by powder compaction, and sintering the resulting compacted powder article at a temperature of 500 to 1,000° C., thereby obtaining a composite soft magnetic material. The thus obtained composite soft magnetic material has a composition including 0.05 to 1% by mass, in terms of $B_2O_3$, $V_2O_5$, $Bi_2O_3$, $Sb_2O_3$, $MoO_3$, of at least one selected from the group including boron oxide, vanadium oxide, bismuth oxide, antimony oxide and molybdenum oxide, and the remainder containing a soft magnetic metal powder coated with a Mg-containing oxide film produced by the method of the present invention. In this case, the Mg-containing oxide film formed on a surface of the soft magnetic metal powder reacts with at least one selected from the group including boron oxide, vanadium oxide, bismuth oxide, antimony oxide and molybdenum oxide to form a desired film.

This composite soft magnetic material can also be produced by adding and mixing at least one selected from the group including a sol solution or powder of boron oxide, a sol solution or powder of vanadium oxide, a sol solution or powder of bismuth oxide, a sol solution or powder of antimony oxide and a sol solution or powder of molybdenum oxide with the soft magnetic metal powder coated with a Mg-containing oxide film to obtain a mixed oxide including 0.05 to 1% by mass, in terms of $B_2O_3$, $V_2O_5$, $Bi_2O_3$, $Sb_2O_3$, $MoO_3$, of the at least one of the above, and the remainder containing the soft magnetic metal powder coated with a Mg-containing oxide film, subjecting the mixed oxide to powder compaction, and sintering the resulting compacted powder article at a temperature of 500 to 1,000° C.

A composite soft magnetic material obtained by using a soft magnetic metal powder coated with a Mg-containing oxide film produced by the method of the present invention has high density, high strength, high resistivity and high magnetic flux density. Further, since this composite soft magnetic material has high magnetic flux density and low iron loss at high frequencies, it can be used as a material for various electromagnetic circuit components, in which such excellent properties of the composite soft magnetic material can be used to advantage.

For producing a composite soft magnetic material from a soft magnetic metal powder coated with a Mg—Si-containing oxide film produced by the method of the present invention, a soft magnetic metal powder coated with a Mg—Si-containing oxide film produced by the method of the present invention is subjected to powder compaction by a conventional method, followed by sintering in an inert gas or oxidizing gas atmosphere at a temperature of 400 to 1,300° C.

Further, a composite soft magnetic material having improved properties with respect to resistivity and strength can be obtained by mixing an organic insulating material, an inorganic insulating material, or a mixed material of an organic insulating material and an inorganic insulating material with a soft magnetic metal powder coated with a Mg—Si-containing oxide film produced by the method of the present invention. In this case, as the organic insulating material, an epoxy resin, fluorine resin, phenol resin, urethane resin, silicone resin, polyester resin, phenoxy resin, urea resin, isocyanate resin, acrylic resin, polyimide resin, or PPS resin can be used. As the inorganic insulating material, a phosphate such as iron phosphate, various glass insulating materials, water glass containing sodium silicate as a main component, or insulative oxide can be used.

Alternatively, a composite soft magnetic material can be obtained by adding and mixing, with a soft magnetic metal powder coated with a Mg—Si-containing oxide film produced by the method of the present invention, at least one selected from the group including boron oxide, vanadium oxide, bismuth oxide, antimony oxide and molybdenum oxide in an amount of 0.05 to 1% by mass, in terms of $B_2O_3$, $V_2O_5$, $Bi_2O_3$, $Sb_2O_3$, $MoO_3$, followed by powder compaction, and sintering the resulting compacted powder article at a temperature of 500 to 1,000° C., thereby obtaining a composite soft magnetic material. The thus obtained composite soft magnetic material has a composition including 0.05 to 1% by mass, in terms of $B_2O_3$, $V_2O_5$, $Bi_2O_3$, $Sb_2O_3$, $MoO_3$, of at least one selected from the group including boron oxide, vanadium oxide, bismuth oxide, antimony oxide and molybdenum oxide, and the remainder containing a soft magnetic metal powder coated with a Mg—Si-containing oxide film produced by the method of the present invention. In this case, the Mg—Si-containing oxide film formed on a surface of the soft magnetic metal powder reacts with at least one selected from the group including boron oxide, vanadium oxide, bismuth oxide, antimony oxide and molybdenum oxide to form a desired film.

This composite soft magnetic material can also be produced by adding and mixing at least one selected from the group including a sol solution or a powder of boron oxide, a sol solution or powder of vanadium oxide, a sol solution or powder of bismuth oxide, a sol solution or powder of antimony oxide and a sol solution or powder of molybdenum oxide with the soft magnetic metal powder coated with a Mg—Si-containing oxide film to obtain a mixed oxide including 0.05 to 1% by mass, in terms of $B_2O_3$, $V_2O_5$, $Bi_2O_3$, $Sb_2O_3$, $MoO_3$, of the at least one of the above, and the remainder containing the soft magnetic metal powder coated with an Mg—Si-containing oxide film, subjecting the mixed oxide to powder compaction, and sintering the resulting compacted powder article at a temperature of 500 to 1,000° C.

Further, a composite soft magnetic material may also be produced by adding and mixing a wet solution such as a silica sol-gel solution (silicate) or alumina sol-gel solution with a soft magnetic metal powder coated with a Mg—Si-containing oxide film according to the present invention, followed by drying, subjecting the resulting dried mixture to compression molding, and sintering the resultant in an inert gas or oxidizing gas atmosphere at a temperature of 500 to 1,000° C.

A composite soft magnetic material obtained by using a soft magnetic metal powder coated with a Mg—Si-containing oxide film produced by the method of the present invention has high density, high strength, high resistivity and high magnetic flux density. Further, since this composite soft magnetic material has high magnetic flux density and low iron loss at high frequencies, it can be used as a material for various electromagnetic circuit components, in which such excellent properties of the composite soft magnetic material can be used to advantage.

BEST MODE FOR CARRYING OUT THE INVENTION

Figure 1A:
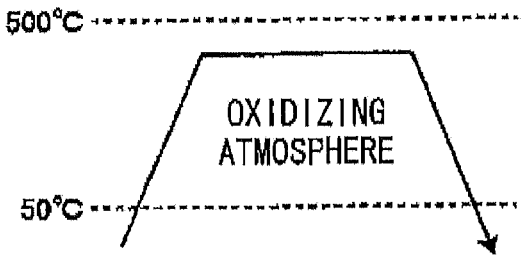
FIGS. 1A to 1D are pattern diagrams showing variations of temperature with time during oxidation treatment of a soft magnetic metal powder.
Figure 1B:
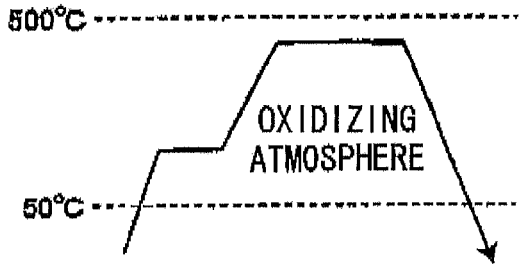
Figure 1C:
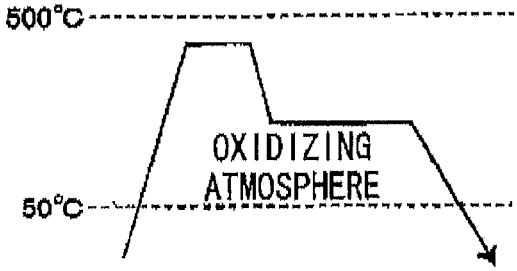
Figure 1D:
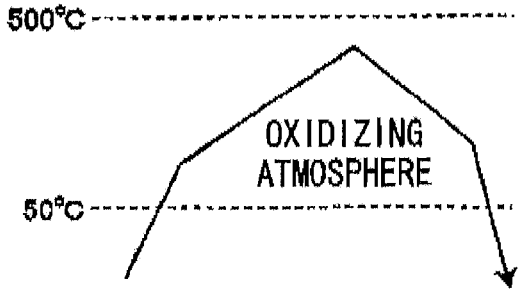
Figure 2A:
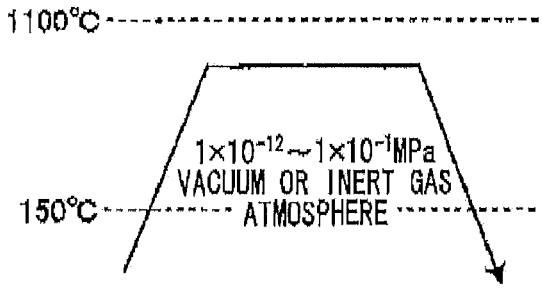
FIG. 2A to 2F are pattern diagrams showing variations of temperature with time during heating of a soft magnetic metal powder which has been subjected to oxidation treatment, while optionally tumbling.
Figure 2B:
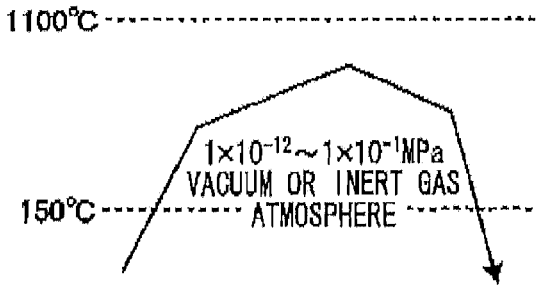
Figure 2C:
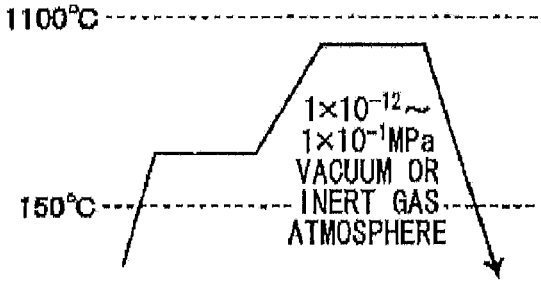
Figure 2D:
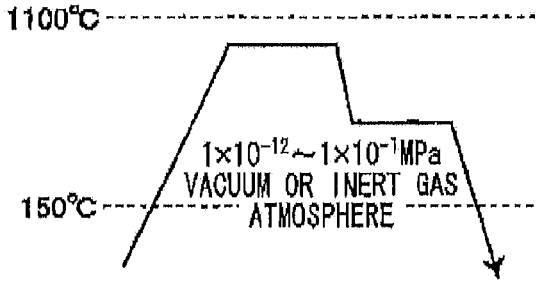
Figure 2E:
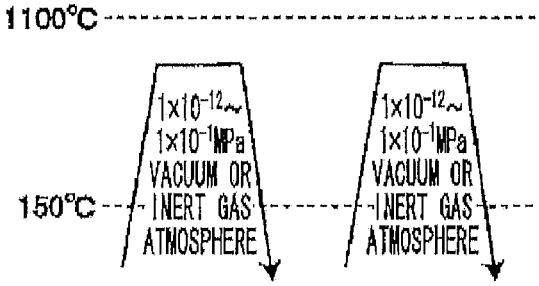
Figure 2F:
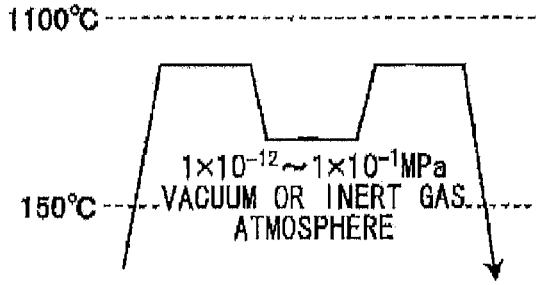
Figure 3A:
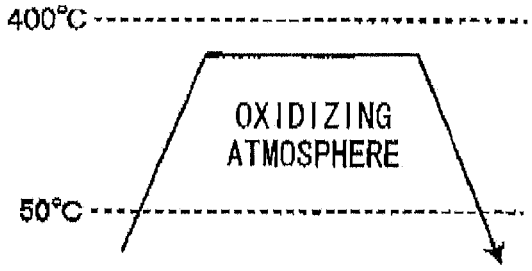
FIGS. 3A to 3D are pattern diagrams showing variations of temperature with time during oxidation treatment following heating, while optionally tumbling.
Figure 3B:
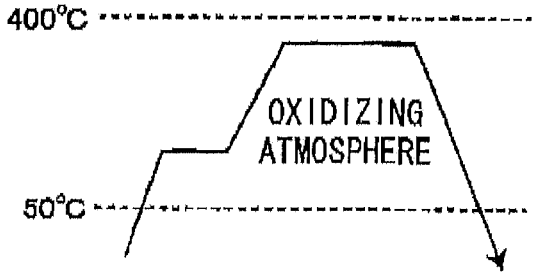
Figure 3C:
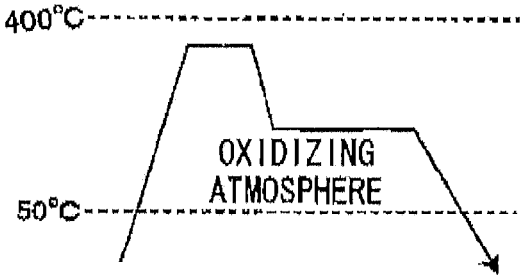
Figure 3D:
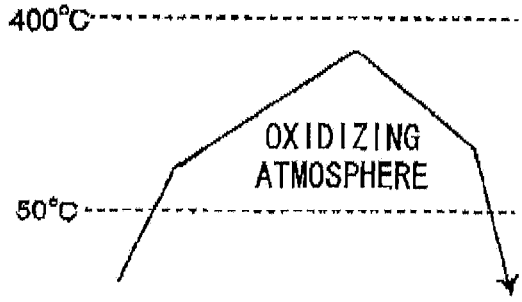

As a soft magnetic metal powder, the following powders, each having an average particle diameter of 70 μm, were prepared:

a pure iron powder (hereafter, referred to as soft magnetic powder A), an atomized Fe—Al iron-based soft magnetic alloy powder including 10% by mass of Al and the remainder containing Fe (hereafter, referred to as soft magnetic powder B), an atomized Fe—Ni iron-based soft magnetic alloy powder including 49% by mass of Ni and the remainder containing Fe (hereafter, referred to as soft magnetic powder C), an atomized Fe—Cr iron-based soft magnetic alloy powder including 10% by mass of Cr and the remainder containing Fe (hereafter, referred to as soft magnetic powder D), an atomized Fe—Si iron-based soft magnetic alloy powder including 3% by mass of Si and the remainder containing Fe (hereafter, referred to as soft magnetic powder E), an atomized Fe—Si—Al iron-based soft magnetic alloy powder including 3% by mass of Si, 3% by mass of Al, and the remainder containing Fe (hereafter, referred to as soft magnetic powder F), an atomized Fe—Co—V iron-based soft magnetic alloy powder including 30% by mass of Co, 2% by mass of V, and the remainder containing Fe (hereafter, referred to as soft magnetic powder G), an atomized Fe—P iron-based soft magnetic alloy powder including 0.6% by mass of P and the remainder containing Fe (hereafter, referred to as soft magnetic powder H), a commercially available insulated-iron powder, which is a phosphate-coated iron powder (hereafter, referred to as soft magnetic powder I), and an Fe—Co iron-based soft magnetic alloy powder including 30% by mass of Co and the remainder containing Fe (hereafter, referred to as soft magnetic powder J).

Separately from the above, a Mg powder having an average particle diameter of 30 μm and a Mg ferrite powder having an average particle diameter of 3 μm were prepared.

Example 1

Present methods 1 to 7 and comparative methods 1 to 3 were performed as follows. To soft magnetic powder A (a pure iron powder), which had been subjected to oxidation treatment under conditions as indicated in Table 1, was added a Mg powder in an amount as indicated in Table 1. Then, the resulting powder was subjected to tumbling in an argon gas or vacuum atmosphere while maintaining the pressure and temperature indicated in Table 1, thereby obtaining a soft magnetic metal powder coated with a Mg-containing oxide film.

The obtained soft magnetic metal powder coated with a Mg-containing oxide film was placed in a mold, and subjected to press molding to obtain a plate-shaped compacted powder article having a size of 55 mm (length)×10 mm (width)×5 mm (thickness) and a ring-shaped compacted powder article having an outer diameter of 35 mm, an inner diameter of 25 mm and a height of 5 mm. Then, the obtained compacted powder articles were sintered in a nitrogen atmosphere while maintaining the temperature as indicated in Table 1 for 30 minutes, thereby obtaining composite soft magnetic materials, which were a plate-shaped sintered article and a ring-shaped sintered article. With respect to the plate-shaped sintered articles obtained by present methods 1 to 7 and comparative methods 1 to 3, the relative density, resistivity and flexural strength were measured. The results are shown in Table 1. Further, coils were wound around the ring-shaped sintered articles obtained by present methods 1 to 7 and comparative methods 1 to 3, and the magnetic flux density was measured using a BH tracer. The results are shown in Table 1.

Conventional Example 1

Conventional method 1 was performed as follows. To the soft magnetic powder A prepared in the examples was added a Mg ferrite powder in an amount indicated in Table 1, followed by stirring in air while tumbling, to thereby obtain a mixed powder. The obtained mixed powder was placed in a mold, and subjected to press molding to obtain a plate-shaped compacted powder article having a size of 55 mm (length)×10 mm (width)×5 mm (thickness) and a ring-shaped compacted powder article having an outer diameter of 35 mm, an inner diameter of 25 mm and a height of 5 mm. Then, the obtained compacted powder articles were sintered in a nitrogen atmosphere while maintaining the temperature as indicated in Table 1 for 30 minutes, thereby obtaining composite soft magnetic materials, which were a plate-shaped sintered article and a ring-shaped sintered article. With respect to the plate-shaped sintered article obtained by conventional method 1, the relative density, resistivity and flexural strength were measured. The results are shown in Table 1. Further, a coil was wound around the ring-shaped sintered article obtained by conventional method 1, and the magnetic flux density was measured using a BH tracer. The results are shown in Table 1.

TABLE 1

| | | | | | Conditions for forming Mg-containing oxide film by tumbling | | | | Properties of composite soft magnetic material | | | |
|---|---|---|---|---|---|---|---|---|---|---|---|---|
| Type of method | | Soft magnetic powder | Condition for oxidation treatment | Amount of Mg or Mg ferrite added (% by Mass) | Atmosphere | Temperature (° C.) | Pressure (MPa) | Sintering temperature (° C.) | Relative density (%) | Flexural Strength (MPa) | Magnetic flux density $B_{10KA/m}$ (T) | Resistivity (μΩm) |
| Present method | 1 | A | Air 200° C. | Mg: 0.2 | Vacuum | 150 | $1 \times 10^{-12}$ | 500 | 98.2 | 170 | 1.65 | 65 |
| | 2 | | | | | 300 | $1 \times 10^{-8}$ | 500 | 98.4 | 180 | 1.68 | 120 |
| | 3 | | | | Argon | 400 | $1 \times 10^{-6}$ | 500 | 98.5 | 190 | 1.69 | 150 |
| | 4 | | | | | 500 | $1 \times 10^{-5}$ | 500 | 98.5 | 195 | 1.69 | 160 |
| | 5 | | | | | 700 | $1 \times 10^{-2}$ | 500 | 98.5 | 180 | 1.68 | 150 |
| | 6 | | | | | 900 | $1 \times 10^{-1}$ | 500 | 98.4 | 170 | 1.67 | 130 |
| | 7 | | | | | 1100 | $1 \times 10^{-1}$ | 500 | 98.3 | 170 | 1.66 | 105 |
| Comparative method | 1 | | | | Vacuum | 120* | $1 \times 10^{-12}$ | 500 | 98.3 | 150 | 1.66 | 8 |
| | 2 | | | | Argon | 1150* | $1 \times 10^{-1}$ | 500 | 98.3 | 165 | 1.66 | 12 |
| | 3 | | | | | 1100 | $1 \times 10^{0}$* | 500 | 98.4 | 80 | 1.66 | 1 |

TABLE 1-continued

| Type of method | Soft magnetic powder | Condition for oxidation treatment | Amount of Mg or Mg ferrite added (% by Mass) | Conditions for forming Mg-containing oxide film by tumbling: Atmosphere | Temperature (° C.) | Pressure (MPa) | Sintering temperature (° C.) | Properties of composite soft magnetic material: Relative density (%) | Flexural Strength (MPa) | Magnetic flux density $B_{10KA/m}$ (T) | Resistivity (μΩm) |
|---|---|---|---|---|---|---|---|---|---|---|---|
| Conventional method 1 | | — | Mg ferrite: 0.33 | — | — | — | 500 | 97.9 | 25 | 1.60 | 0.2 |

*indicates a value outside the range of the present invention

Another Embodiment of Example 1

Present methods 1' to 7', comparative methods 1' to 3', and conventional method 1' were performed as follows. To a raw powder material A (a pure iron powder) was added a Mg powder in an amount as indicated in Table 2, which is the same as Example 1, and the resulting powder was subjected to tumbling in an argon gas or vacuum atmosphere while maintaining the pressure and temperature indicated in Table 2. Then, the resultant was subjected to oxidation treatment under conditions as indicated in Table 2, thereby obtaining a soft magnetic metal powder coated with a Mg-containing oxide film.

The results of present methods 1' to 7', comparative methods 1' to 3', and conventional method 1' are shown in Table 2.

TABLE 2

| Type of method | | Raw powder material | Amount of Mg or Mg ferrite added (% by Mass) | Conditions for heat tumbling of raw powder material and Mg powder: Atmosphere | Temperature (° C.) | Pressure (MPa) | Conditions for oxidation treatment | Sintering temperature (° C.) | Properties of composite soft magnetic material: Relative density (%) | Flexural Strength (MPa) | Magnetic flux density $B_{10KA/m}$ (T) | Resistivity (μΩm) |
|---|---|---|---|---|---|---|---|---|---|---|---|---|
| Present method | 1' | A | Mg: 0.2 | Vacuum | 150 | $1 \times 10^{-12}$ | Air 200° C. | 500 | 98.3 | 175 | 1.65 | 65 |
| | 2' | | | | 300 | $1 \times 10^{-8}$ | | 500 | 98.4 | 180 | 1.68 | 125 |
| | 3' | | | Argon | 400 | $1 \times 10^{-6}$ | | 500 | 98.5 | 185 | 1.69 | 155 |
| | 4' | | | | 500 | $1 \times 10^{-5}$ | | 500 | 98.5 | 195 | 1.69 | 165 |
| | 5' | | | | 700 | $1 \times 10^{-2}$ | | 500 | 98.5 | 175 | 1.69 | 150 |
| | 6' | | | | 900 | $1 \times 10^{-1}$ | | 500 | 98.4 | 170 | 1.67 | 135 |
| | 7' | | | | 1100 | $1 \times 10^{-1}$ | | 500 | 98.3 | 165 | 1.66 | 110 |
| Comparative method | 1' | | | Vacuum | 120* | $1 \times 10^{-12}$ | | 500 | 98.3 | 150 | 1.66 | 8 |
| | 2' | | | Argon | 1150* | $1 \times 10^{-1}$ | | 500 | 98.3 | 165 | 1.66 | 13 |
| | 3' | | | | 1100 | $1 \times 10^{0}$* | | 500 | 98.4 | 85 | 1.66 | 1 |
| Conventional method 1' | | | Mg ferrite: 0.33 | — | — | — | — | 500 | 97.9 | 25 | 1.60 | 0.2 |

*indicates a value outside the range of the present invention

As can be seen from the results shown in Tables 1 and 2, the composite soft magnetic materials produced by the present methods 1 to 7 and 1' to 7' have excellent properties with respect to flexural strength, magnetic flux density and resistivity, as compared to the composite soft magnetic materials produced by the conventional methods 1 and 1'. On the other hand, the composite soft magnetic materials produced by the comparative methods 1 to 3 and 1' to 3' have poor properties with respect to relative density and magnetic flux density.

Example 2

Present methods 8 to 14 and comparative methods 4 to 6 were performed as follows. To soft magnetic powder B (an Fe—Al iron-based soft magnetic alloy powder), which had been subjected to oxidation treatment under conditions as indicated in Table 3, was added a Mg powder in an amount as indicated in Table 3. Then, the resulting powder was subjected to tumbling in an argon gas or vacuum atmosphere while maintaining the pressure and temperature indicated in Table 3, thereby obtaining a soft magnetic metal powder coated with a Mg-containing oxide film.

The obtained soft magnetic metal powder coated with a Mg-containing oxide film was placed in a mold, and subjected to press molding to obtain a plate-shaped compacted powder article having a size of 55 mm (length)×10 mm (width)×5 mm (thickness) and a ring-shaped compacted powder article having an outer diameter of 35 mm, an inner diameter of 25 mm and a height of 5 mm. Then, the obtained compacted powder articles were sintered in a nitrogen atmosphere while maintaining the temperature as indicated in Table 3 for 30 minutes, thereby obtaining composite soft magnetic materials, which were a plate-shaped sintered article and a ring-shaped sintered article. With respect to the plate-shaped sintered articles obtained in present methods 8 to 14 and comparative methods 4 to 6, the relative density, resistivity and flexural strength were measured. The results are shown in Table 3. Further, coils were wound around the ring-shaped sintered articles obtained in present methods 8 to 14 and comparative methods 4 to 6, and the magnetic flux density was measured using a BH tracer. The results are shown in Table 3.

Conventional Example 2

Conventional method 2 was performed as follows. To the soft magnetic powder B prepared in the examples was added a Mg ferrite powder in an amount indicated in Table 3, followed by stirring in air while tumbling, to thereby obtain a mixed powder. The obtained mixed powder was placed in a mold, and subjected to press molding to obtain a plate-shaped compacted powder article having a size of 55 mm (length)×10 mm (width)×5 mm (thickness) and a ring-shaped compacted powder article having an outer diameter of 35 mm, an inner diameter of 25 mm and a height of 5 mm. Then, the obtained compacted powder articles were sintered in a nitrogen atmosphere while maintaining the temperature as indicated in Table 3 for 30 minutes, thereby obtaining composite soft magnetic materials, which were a plate-shaped sintered article and a ring-shaped sintered article. With respect to the plate-shaped sintered article obtained in conventional method 2, the relative density, resistivity and flexural strength were measured. The results are shown in Table 3. Further, a coil was wound around the ring-shaped sintered article obtained in conventional method 2, and the magnetic flux density was measured using a BH tracer. The results are shown in Table 3.

TABLE 3

| Type of method | | Soft magnetic powder | Conditions for oxidation treatment | Amount of Mg or Mg ferrite added (% by Mass) | Conditions for forming Mg-containing oxide film by tumbling: Atmosphere | Temperature (° C.) | Pressure (MPa) | Sintering temperature (° C.) | Properties of composite soft magnetic material: Relative density (%) | Flexural Strength (MPa) | Magnetic flux density $B_{10KA/m}$ (T) | Resistivity (μΩm) |
|---|---|---|---|---|---|---|---|---|---|---|---|---|
| Present method | 8 | B | $O_2$: 5%, $N_2$: 95% 500° C. | Mg: 0.1 | Vacuum | 150 | $1 \times 10^{-12}$ | 800 | 98.3 | 180 | 1.53 | 70 |
| | 9 | | | | | 300 | $1 \times 10^{-8}$ | 800 | 98.4 | 190 | 1.55 | 140 |
| | 10 | | | | Argon | 400 | $1 \times 10^{-6}$ | 800 | 98.5 | 205 | 1.55 | 180 |
| | 11 | | | | | 500 | $1 \times 10^{-5}$ | 800 | 98.6 | 220 | 1.56 | 200 |
| | 12 | | | | | 700 | $1 \times 10^{-2}$ | 800 | 98.5 | 210 | 1.55 | 215 |
| | 13 | | | | | 900 | $1 \times 10^{-1}$ | 800 | 98.3 | 210 | 1.55 | 210 |
| | 14 | | | | | 1100 | $1 \times 10^{-1}$ | 800 | 98.3 | 200 | 1.53 | 100 |
| Comparative method | 4 | | | | Vacuum | 120* | $1 \times 10^{-12}$ | 800 | 98.3 | 170 | 1.51 | 9 |
| | 5 | | | | Argon | 1150* | $1 \times 10^{-1}$ | 800 | 98.2 | 185 | 1.52 | 12 |
| | 6 | | | | | 1100 | $1 \times 10^{0}$* | 800 | 98.4 | 70 | 1.55 | 2 |
| Conventional method 2 | | | | Mg ferrite: 0.17 | — | — | — | 800 | 97.4 | 30 | 1.47 | 1 |

*indicates a value outside the range of the present invention

Another Embodiment of Example 2

Present methods 8' to 14', comparative methods 4' to 6', and conventional method 2' were performed as follows. To a raw powder material B (an Fe—Al iron-based soft magnetic alloy powder) was added a Mg powder in an amount as indicated in Table 4, which is the same as Example 2, and the resulting powder was subjected to tumbling in an argon gas or vacuum atmosphere while maintaining the pressure and temperature indicated in Table 4. Then, the resultant was subjected to oxidation treatment under conditions as indicated in Table 4, thereby obtaining a soft magnetic metal powder coated with a Mg-containing oxide film.

The results of present methods 8' to 14', comparative methods 4' to 6', and conventional method 2' are shown in Table 4.

TABLE 4

| Type of method | | Raw powder material | Amount of Mg or Mg ferrite added (% by Mass) | Conditions for heat tumbling of raw powder material and Mg powder: Atmosphere | Temperature (° C.) | Pressure (MPa) | Conditions for oxidation treatment | Sintering temperature (° C.) | Properties of composite soft magnetic material: Relative density (%) | Flexural Strength (MPa) | Magnetic flux density $B_{10KA/m}$ (T) | Resistivity (μΩm) |
|---|---|---|---|---|---|---|---|---|---|---|---|---|
| Present method | 8' | B | Mg: 0.1 | Vacuum | 150 | $1 \times 10^{-12}$ | $O_2$: 5%, $N_2$: 95% 400° C. | 800 | 98.3 | 180 | 1.53 | 70 |
| | 9' | | | | 300 | $1 \times 10^{-8}$ | | 800 | 98.4 | 185 | 1.55 | 145 |
| | 10' | | | Argon | 400 | $1 \times 10^{-6}$ | | 800 | 98.5 | 210 | 1.55 | 180 |
| | 11' | | | | 500 | $1 \times 10^{-5}$ | | 800 | 98.6 | 220 | 1.56 | 200 |
| | 12' | | | | 700 | $1 \times 10^{-2}$ | | 800 | 98.5 | 210 | 1.55 | 215 |
| | 13' | | | | 900 | $1 \times 10^{-1}$ | | 800 | 98.4 | 205 | 1.54 | 200 |
| | 14' | | | | 1100 | $1 \times 10^{-1}$ | | 800 | 98.3 | 200 | 1.53 | 100 |
| Comparative method | 4' | | | Vacuum | 120* | $1 \times 10^{-12}$ | | 800 | 98.2 | 170 | 1.51 | 9 |
| | 5' | | | Argon | 1150* | $1 \times 10^{-1}$ | | 800 | 98.4 | 185 | 1.52 | 11 |
| | 6' | | | | 1100 | $1 \times 10^{0}$* | | 800 | 98.4 | 70 | 1.55 | 2 |
| Conventional method 2' | | | Mg ferrite: 0.17 | — | — | — | — | 800 | 97.4 | 30 | 1.47 | 1 |

*indicates a value outside the range of the present invention

As can be seen from the results shown in Tables 3 and 4, the composite soft magnetic materials produced by the present methods 8 to 14 and 8' to 14' have excellent properties with respect to flexural strength, magnetic flux density and resistivity, as compared to the composite soft magnetic materials produced by the conventional methods 2 and 2'. On the other hand, the composite soft magnetic materials produced by the comparative methods 4 to 6 and 4' to 6' have poor properties with respect to relative density and magnetic flux density.

Example 3

Present methods 15 to 21 and comparative methods 7 to 9 were performed as follows. To soft magnetic powder C (an Fe—Ni iron-based soft magnetic alloy powder), which had been subjected to oxidation treatment under conditions as indicated in Table 5, was added a Mg powder in an amount as indicated in Table 5. Then, the resulting powder was subjected to tumbling in an argon gas or vacuum atmosphere while maintaining the pressure and temperature indicated in Table 5, thereby obtaining a soft magnetic metal powder coated with a Mg-containing oxide film.

The obtained soft magnetic metal powder coated with a Mg-containing oxide film was placed in a mold, and subjected to press molding to obtain a plate-shaped compacted powder article having a size of 55 mm (length)×10 mm (width)×5 mm (thickness) and a ring-shaped compacted powder article having an outer diameter of 35 mm, an inner diameter of 25 mm and a height of 5 mm. Then, the obtained compacted powder articles were sintered in a nitrogen atmosphere while maintaining the temperature as indicated in Table 5 for 30 minutes, thereby obtaining composite soft magnetic materials, which were a plate-shaped sintered article and a ring-shaped sintered article. With respect to the plate-shaped sintered articles obtained in present methods 15 to 21 and comparative methods 7 to 9, the relative density, resistivity and flexural strength were measured. The results are shown in Table 5. Further, coils were wound around the ring-shaped sintered articles obtained in present methods 15 to 21 and comparative methods 7 to 9, and the magnetic flux density was measured using a BH tracer. The results are shown in Table 5.

Conventional Example 3

Conventional method 3 was performed as follows. To the soft magnetic powder C prepared in the examples was added a Mg ferrite powder in an amount indicated in Table 5, followed by stirring in air while tumbling, to thereby obtain a mixed powder. The obtained mixed powder was placed in a mold, and subjected to press molding to obtain a plate-shaped compacted powder article having a size of 55 mm (length)×10 mm (width)×5 mm (thickness) and a ring-shaped compacted powder article having an outer diameter of 35 mm, an inner diameter of 25 mm and a height of 5 mm. Then, the obtained compacted powder articles were sintered in a nitrogen atmosphere while maintaining the temperature as indicated in Table 5 for 30 minutes, thereby obtaining composite soft magnetic materials, which were a plate-shaped sintered article and a ring-shaped sintered article. With respect to the plate-shaped sintered article obtained in conventional method 3, the relative density, resistivity and flexural strength were measured. The results are shown in Table 5. Further, a coil was wound around the ring-shaped sintered article obtained in conventional method 3, and the magnetic flux density was measured using a BH tracer. The results are shown in Table 5.

TABLE 5

| | | | | | Conditions for forming Mg-containing oxide film by tumbling | | | | Properties of composite soft magnetic material | | | |
|---|---|---|---|---|---|---|---|---|---|---|---|---|
| Type of method | | Soft magnetic powder | Conditions for oxidation treatment | Amount of Mg or Mg ferrite added (% by Mass) | Atmosphere | Temperature (° C.) | Pressure (MPa) | Sintering temperature (° C.) | Relative density (%) | Flexural Strength (MPa) | Magnetic flux density $B_{10KA/m}$ (T) | Resistivity (μΩm) |
| Present method | 15 | C | $O_2$: 70%, $N_2$: 30% 500° C. | Mg: 0.05 | Vacuum | 150 | $1 \times 10^{-12}$ | 1000 | 98.4 | 185 | 1.48 | 70 |
| | 16 | | | | | 300 | $1 \times 10^{-8}$ | 1000 | 98.5 | 190 | 1.50 | 135 |
| | 17 | | | | Argon | 400 | $1 \times 10^{-6}$ | 1000 | 98.5 | 210 | 1.51 | 160 |
| | 18 | | | | | 500 | $1 \times 10^{-5}$ | 1000 | 98.5 | 220 | 1.51 | 175 |
| | 19 | | | | | 700 | $1 \times 10^{-2}$ | 1000 | 98.5 | 220 | 1.50 | 160 |
| | 20 | | | | | 900 | $1 \times 10^{-1}$ | 1000 | 98.4 | 205 | 1.49 | 150 |
| | 21 | | | | | 1100 | $1 \times 10^{-1}$ | 1000 | 98.3 | 180 | 1.46 | 80 |
| Comparative method | 7 | | | | Vacuum | 120* | $1 \times 10^{-12}$ | 1000 | 98.4 | 170 | 1.47 | 12 |
| | 8 | | | | Argon | 1150* | $1 \times 10^{-1}$ | 1000 | 98.2 | 165 | 1.44 | 15 |
| | 9 | | | | | 1100 | $1 \times 10^{0}$* | 1000 | 98.5 | 60 | 1.50 | 3 |
| Conventional method 3 | | | — | Mg ferrite: 0.08 | — | — | — | 1000 | 97.9 | 25 | 1.44 | 0.7 |

*indicates a value outside the range of the present invention

Another Embodiment of Example 3

Present methods 15' to 21', comparative methods 7' to 9', and conventional method 3' were performed as follows. To a raw powder material C (an Fe—Ni iron-based soft magnetic alloy powder) was added a Mg powder in an amount as indicated in Table 6, which is the same as Example 3, and the resulting powder was subjected to tumbling in an argon gas or vacuum atmosphere while maintaining the pressure and temperature indicated in Table 6. Then, the resultant was subjected to oxidation treatment under conditions as indicated in Table 6, thereby obtaining a soft magnetic metal powder coated with a Mg-containing oxide film.

The results of present methods 15' to 21', comparative methods 7' to 9', and conventional method 3' are shown in Table 6.

TABLE 6

| Type of method | | Raw powder material | Amount of Mg or Mg ferrite added (% by Mass) | Conditions for heat tumbling of raw powder material and Mg powder: Atmosphere | Temperature (° C.) | Pressure (MPa) | Conditions for oxidation treatment | Sintering temperature (° C.) | Properties of composite soft magnetic material: Relative density (%) | Flexural Strength (MPa) | Magnetic flux density $B_{10KA/m}$ (T) | Resistivity (μΩm) |
|---|---|---|---|---|---|---|---|---|---|---|---|---|
| Present method | 15' | C | Mg: 0.05 | Vacuum | 150 | $1 \times 10^{-12}$ | $O_2$: 70%, $N_2$: 30% 500° C. | 1000 | 98.4 | 185 | 1.48 | 70 |
| | 16' | | | | 300 | $1 \times 10^{-8}$ | | 1000 | 98.5 | 190 | 1.50 | 135 |
| | 17' | | | Argon | 400 | $1 \times 10^{-6}$ | | 1000 | 98.5 | 210 | 1.50 | 160 |
| | 18' | | | | 500 | $1 \times 10^{-5}$ | | 1000 | 98.5 | 215 | 1.50 | 175 |
| | 19' | | | | 700 | $1 \times 10^{-2}$ | | 1000 | 98.5 | 220 | 1.51 | 155 |
| | 20' | | | | 900 | $1 \times 10^{-1}$ | | 1000 | 98.4 | 210 | 1.49 | 150 |
| | 21' | | | | 1100 | $1 \times 10^{-1}$ | | 1000 | 98.3 | 180 | 1.46 | 80 |
| Comparative method | 7' | | | Vacuum | 120* | $1 \times 10^{-12}$ | | 1000 | 98.4 | 170 | 1.47 | 12 |
| | 8' | | | Argon | 1150* | $1 \times 10^{-1}$ | | 1000 | 98.2 | 160 | 1.44 | 15 |
| | 9' | | | | 1100 | $1 \times 10^{0}$* | | 1000 | 98.4 | 55 | 1.49 | 4 |
| Conventional method 3' | | | Mg ferrite: 0.08 | — | — | — | — | — | 97.9 | 25 | 1.44 | 0.7 |

*indicates a value outside the range of the present invention

As can be seen from the results shown in Tables 5 and 6, the composite soft magnetic materials produced by the present methods 15 to 21 and 15' to 21' have excellent properties with respect to flexural strength, magnetic flux density and resistivity, as compared to the composite soft magnetic materials produced by the conventional methods 3 and 3'. On the other hand, the composite soft magnetic materials produced by the comparative methods 7 to 9 and 7' to 9' have poor properties with respect to relative density and magnetic flux density.

Example 4

Present methods 22 to 28 and comparative methods 10 to 12 were performed as follows. To soft magnetic powder D (an Fe—Cr iron-based soft magnetic alloy powder), which had been subjected to oxidation treatment under conditions as indicated in Table 7, was added a Mg powder in an amount as indicated in Table 7. Then, the resulting powder was subjected to tumbling in an argon gas or vacuum atmosphere while maintaining the pressure and temperature indicated in Table 7, thereby obtaining a soft magnetic metal powder coated with a Mg-containing oxide film.

The obtained soft magnetic metal powder coated with a Mg-containing oxide film was placed in a mold, and subjected to press molding to obtain a plate-shaped compacted powder article having a size of 55 mm (length)×10 mm (width)×5 mm (thickness) and a ring-shaped compacted powder article having an outer diameter of 35 mm, an inner diameter of 25 mm and a height of 5 mm. Then, the obtained compacted powder articles were sintered in a nitrogen atmosphere while maintaining the temperature as indicated in Table 7 for 30 minutes, thereby obtaining composite soft magnetic materials, which were a plate-shaped sintered article and a ring-shaped sintered article. With respect to the plate-shaped sintered articles obtained in present methods 22 to 28 and comparative methods 10 to 12, the relative density, resistivity and flexural strength were measured. The results are shown in Table 7. Further, coils were wound around the ring-shaped sintered articles obtained in present methods 22 to 28 and comparative methods 10 to 12, and the magnetic flux density was measured using a BH tracer. The results are shown in Table 7.

Conventional Example 4

Conventional method 4 was performed as follows. To the soft magnetic powder D prepared in the examples was added a Mg ferrite powder in an amount indicated in Table 7, followed by stirring in air while tumbling, to thereby obtain a mixed powder. The obtained mixed powder was placed in a mold, and subjected to press molding to obtain a plate-shaped compacted powder article having a size of 55 mm (length)×10 mm (width)×5 mm (thickness) and a ring-shaped compacted powder article having an outer diameter of 35 mm, an inner diameter of 25 mm and a height of 5 mm. Then, the obtained compacted powder articles were sintered in a nitrogen atmosphere while maintaining the temperature as indicated in Table 7 for 30 minutes, thereby obtaining composite soft magnetic materials, which were a plate-shaped sintered article and a ring-shaped sintered article. With respect to the plate-shaped sintered article obtained in conventional method 4, the relative density, resistivity and flexural strength were measured. The results are shown in Table 7. Further, a coil was wound around the ring-shaped sintered article obtained in conventional method 4, and the magnetic flux density was measured using a BH tracer. The results are shown in Table 7.

TABLE 7

| Type of method | | Soft magnetic powder | Conditions for oxidation treatment | Amount of Mg or Mg ferrite added (% by Mass) | Conditions for forming Mg-containing oxide film by tumbling: Atmosphere | Temperature (° C.) | Pressure (MPa) | Sintering temperature (° C.) | Properties of composite soft magnetic material: Relative density (%) | Flexural Strength (MPa) | Magnetic flux density $B_{10KA/m}$ (T) | Resistivity (μΩm) |
|---|---|---|---|---|---|---|---|---|---|---|---|---|
| Present method | 22 | D | Air 500° C. | Mg: 0.08 | Vacuum | 150 | $1 \times 10^{-12}$ | 1200 | 98.2 | 250 | 1.55 | 85 |
| | 23 | | | | | 300 | $1 \times 10^{-8}$ | 1200 | 98.3 | 275 | 1.56 | 140 |
| | 24 | | | | Argon | 400 | $1 \times 10^{-6}$ | 1200 | 98.4 | 310 | 1.57 | 170 |
| | 25 | | | | | 500 | $1 \times 10^{-5}$ | 1200 | 98.4 | 330 | 1.58 | 210 |
| | 26 | | | | | 700 | $1 \times 10^{-2}$ | 1200 | 98.4 | 320 | 1.58 | 205 |
| | 27 | | | | | 900 | $1 \times 10^{-1}$ | 1200 | 98.4 | 305 | 1.57 | 170 |
| | 28 | | | | | 1100 | $1 \times 10^{-1}$ | 1200 | 98.4 | 290 | 1.56 | 115 |
| Comparative method | 10 | | | | Vacuum | 120* | $1 \times 10^{-12}$ | 1200 | 98.0 | 130 | 1.52 | 14 |
| | 11 | | | | Argon | 1150* | $1 \times 10^{-1}$ | 1200 | 98.1 | 160 | 1.53 | 19 |
| | 12 | | | | | 1100 | $1 \times 10^{0}$* | 1200 | 98.3 | 120 | 1.56 | 5 |
| Conventional method 4 | | | — | Mg ferrite: 0.14 | — | — | — | 1200 | 97.7 | 50 | 1.40 | 0.5 |

*indicates a value outside the range of the present invention

Another Embodiment of Example 4

Present methods 22' to 35', comparative methods 10' to 15', and conventional method 4' were performed as follows. To a raw powder material D (an Fe—Cr iron-based soft magnetic alloy powder) was added a Mg powder in an amount as indicated in Table 8, which is the same as Example 4, and the resulting powder was subjected to tumbling in an argon gas or vacuum atmosphere while maintaining the pressure and temperature indicated in Table 8. Then, the resultant was subjected to oxidation treatment under conditions as indicated in Table 8, thereby obtaining a soft magnetic metal powder coated with a Mg-containing oxide film.

The results of present methods 22' to 35', comparative methods 10' to 15', and conventional method 4' are shown in Table 8.

TABLE 8

| Type of method | | Raw powder material | Amount of Mg or Mg ferrite added (% by Mass) | Conditions for heat tumbling of raw powder material and Mg powder: Atmosphere | Temperature (° C.) | Pressure (MPa) | Conditions for oxidation treatment | Sintering temperature (° C.) | Properties of composite soft magnetic material: Relative density (%) | Flexural Strength (MPa) | Magnetic flux density $B_{10KA/m}$ (T) | Resistivity (μΩm) |
|---|---|---|---|---|---|---|---|---|---|---|---|---|
| Present method | 22' | D | Mg: 0.08 | Vacuum | 150 | $1 \times 10^{-12}$ | Air 400° C. | 1200 | 98.2 | 250 | 1.55 | 85 |
| | 23' | | | | 300 | $1 \times 10^{-8}$ | | 1200 | 98.3 | 275 | 1.56 | 140 |
| | 24' | | | Argon | 400 | $1 \times 10^{-6}$ | | 1200 | 98.4 | 310 | 1.57 | 170 |
| | 25' | | | | 500 | $1 \times 10^{-5}$ | | 1200 | 98.5 | 335 | 1.59 | 205 |
| | 26' | | | | 700 | $1 \times 10^{-2}$ | | 1200 | 98.4 | 320 | 1.58 | 205 |
| | 27' | | | | 900 | $1 \times 10^{-1}$ | | 1200 | 98.4 | 305 | 1.57 | 170 |
| | 28' | | | | 1100 | $1 \times 10^{-1}$ | | 1200 | 98.4 | 290 | 1.56 | 115 |
| | 29' | | | Vacuum | 150 | $1 \times 10^{-12}$ | | 1150 | 98.1 | 240 | 1.54 | 90 |
| | 30' | | | | 300 | $1 \times 10^{-8}$ | | 1150 | 98.2 | 270 | 1.55 | 141 |
| | 31' | | | Argon | 400 | $1 \times 10^{-6}$ | | 1150 | 98.2 | 300 | 1.56 | 175 |
| | 32' | | | | 500 | $1 \times 10^{-5}$ | | 1150 | 98.4 | 320 | 1.58 | 212 |
| | 33' | | | | 700 | $1 \times 10^{-2}$ | | 1150 | 98.3 | 300 | 1.57 | 210 |
| | 34' | | | | 900 | $1 \times 10^{-1}$ | | 1150 | 98.3 | 290 | 1.56 | 185 |
| | 35' | | | | 1100 | $1 \times 10^{-1}$ | | 1150 | 98.2 | 275 | 1.54 | 120 |
| Comparative method | 10' | | | Vacuum | 120* | $1 \times 10^{-12}$ | | 1200 | 98.0 | 130 | 1.52 | 14 |
| | 11' | | | Argon | 1150* | $1 \times 10^{-1}$ | | 1200 | 98.1 | 160 | 1.53 | 19 |
| | 12' | | | | 1100 | $1 \times 10^{-0}$* | | 1200 | 98.3 | 120 | 1.56 | 5 |
| | 13' | | | Vacuum | 120* | $1 \times 10^{-12}$ | | 1150 | 97.9 | 120 | 1.51 | 19 |
| | 14' | | | Argon | 1150* | $1 \times 10^{-1}$ | | 1150 | 98.0 | 150 | 1.52 | 25 |
| | 15' | | | | 1100 | $1 \times 10^{-0}$* | | 1150 | 98.1 | 110 | 1.53 | 8 |
| Conventional method | 4' | | Mg ferrite: 0.14 | — | — | — | — | 1200 | 97.7 | 50 | 1.40 | 0.5 |

*indicates a value outside the range of the present invention

As can be seen from the results shown in Tables 7 and 8, the composite soft magnetic materials produced by the present methods 22 to 28 and 22' to 35' have excellent properties with respect to flexural strength, magnetic flux density and resistivity, as compared to the composite soft magnetic materials produced by the conventional methods 4 and 4'. On the other hand, the composite soft magnetic materials produced by the comparative methods 10 to 12 and 10' to 15' have poor properties with respect to relative density and magnetic flux density.

Example 5

Present methods 29 to 35 and comparative methods 13 to 15 were performed as follows. To soft magnetic powder E (an Fe—Si iron-based soft magnetic alloy powder), which had been subjected to oxidation treatment under conditions as indicated in Table 9, was added a Mg powder in an amount as indicated in Table 9. Then, the resulting powder was subjected to tumbling in an argon gas or vacuum atmosphere while maintaining the pressure and temperature indicated in Table 9, thereby obtaining a soft magnetic metal powder coated with a Mg-containing oxide film.

The obtained soft magnetic metal powder coated with a Mg-containing oxide film was placed in a mold, and subjected to press molding to obtain a plate-shaped compacted powder article having a size of 55 mm (length)×10 mm (width)×5 mm (thickness) and a ring-shaped compacted powder article having an outer diameter of 35 mm, an inner diameter of 25 mm and a height of 5 mm. Then, the obtained compacted powder articles were sintered in a nitrogen atmosphere while maintaining the temperature as indicated in Table 9 for 30 minutes, thereby obtaining composite soft magnetic materials, which were a plate-shaped sintered article and a ring-shaped sintered article. With respect to the plate-shaped sintered articles obtained in present methods 29 to 35 and comparative methods 13 to 15, the relative density, resistivity and flexural strength were measured. The results are shown in Table 9. Further, coils were wound around the ring-shaped sintered articles obtained in present methods 29 to 35 and comparative methods 13 to 15, and the magnetic flux density was measured using a BH tracer. The results are shown in Table 9.

Conventional Example 5

Conventional method 5 was performed as follows. To the soft magnetic powder E prepared in the examples was added a Mg ferrite powder in an amount indicated in Table 9, followed by stirring in air while tumbling, to thereby obtain a mixed powder. The obtained mixed powder was placed in a mold, and subjected to press molding to obtain a plate-shaped compacted powder article having a size of 55 mm (length)×10 mm (width)×5 mm (thickness) and a ring-shaped compacted powder article having an outer diameter of 35 mm, an inner diameter of 25 mm and a height of 5 mm. Then, the obtained compacted powder articles were sintered in a nitrogen atmosphere while maintaining the temperature as indicated in Table 9 for 30 minutes, thereby obtaining composite soft magnetic materials, which were a plate-shaped sintered article and a ring-shaped sintered article. With respect to the plate-shaped sintered article obtained in conventional method 5, the relative density, resistivity and flexural strength were measured. The results are shown in Table 9. Further, a coil was wound around the ring-shaped sintered article obtained in conventional method 5, and the magnetic flux density was measured using a BH tracer. The results are shown in Table 9.

TABLE 9

| Type of method | | Soft magnetic powder | Conditions for oxidation treatment | Amount of Mg or Mg ferrite added (% by Mass) | Conditions for forming Mg-containing oxide film by tumbling: Atmosphere | Temperature (° C.) | Pressure (MPa) | Sintering temperature (° C.) | Properties of composite soft magnetic material: Relative density (%) | Flexural Strength (MPa) | Magnetic flux density $B_{10KA/m}$ (T) | Resistivity (μΩm) |
|---|---|---|---|---|---|---|---|---|---|---|---|---|
| Present method | 29 | E | Air 150° C. | Mg: 1 | Vacuum | 150 | $1 \times 10^{-12}$ | 1000 | 96.3 | 145 | 1.47 | 90 |
| | 30 | | | | | 300 | $1 \times 10^{-8}$ | 1000 | 96.4 | 160 | 1.48 | 155 |
| | 31 | | | | Argon | 400 | $1 \times 10^{-6}$ | 1000 | 96.6 | 180 | 1.50 | 170 |
| | 32 | | | | | 500 | $1 \times 10^{-5}$ | 1000 | 96.6 | 195 | 1.51 | 180 |
| | 33 | | | | | 700 | $1 \times 10^{-2}$ | 1000 | 96.5 | 190 | 1.50 | 175 |
| | 34 | | | | | 900 | $1 \times 10^{-1}$ | 1000 | 96.5 | 180 | 1.50 | 160 |
| | 35 | | | | | 1100 | $1 \times 10^{-1}$ | 1000 | 96.3 | 180 | 1.48 | 85 |
| Comparative method | 13 | | | | Vacuum | 120* | $1 \times 10^{-12}$ | 1000 | 96.2 | 120 | 1.46 | 10 |
| | 14 | | | | Argon | 1150* | $1 \times 10^{-1}$ | 1000 | 96.1 | 165 | 1.45 | 17 |
| | 15 | | | | | 1100 | $1 \times 10^{0}$* | 1000 | 96.3 | 70 | 1.47 | 1.5 |
| Conventional method 5 | | | — | Mg ferrite: 1.7 | — | — | — | 1000 | 94.0 | 20 | 1.38 | 0.6 |

*indicates a value outside the range of the present invention

Another Embodiment of Example 5

Present methods 36' to 49', comparative methods 16' to 21', and conventional method 5' were performed as follows. To a raw powder material E (an Fe—Si iron-based soft magnetic alloy powder) was added a Mg powder in an amount as indicated in Table 10, which is the same as Example 5, and the resulting powder was subjected to tumbling in an argon gas or vacuum atmosphere while maintaining the pressure and temperature indicated in Table 10. Then, the resultant was subjected to oxidation treatment under conditions as indicated in Table 10, thereby obtaining a soft magnetic metal powder coated with an Mg-containing oxide film.

The results of present methods 36' to 49', comparative methods 16' to 21', and conventional method 5' are shown in Table 10.

TABLE 10

| Type of method | | Raw powder material | Amount of Mg or Mg ferrite added (% by Mass) | Conditions for heat tumbling of raw powder material and Mg powder: Atmosphere | Temperature (° C.) | Pressure (MPa) | Conditions for oxidation treatment | Sintering temperature (° C.) | Properties of composite soft magnetic material: Relative density (%) | Flexural Strength (MPa) | Magnetic flux density $B_{10KA/m}$ (T) | Resistivity (μΩm) |
|---|---|---|---|---|---|---|---|---|---|---|---|---|
| Present method | 36' | E | Mg: 1 | Vacuum | 150 | $1 \times 10^{-12}$ | Air 150° C. | 1000 | 96.3 | 145 | 1.47 | 90 |
| | 37' | | | | 300 | $1 \times 10^{-8}$ | | 1000 | 96.4 | 160 | 1.48 | 155 |
| | 38' | | | Argon | 400 | $1 \times 10^{-6}$ | | 1000 | 96.5 | 175 | 1.49 | 175 |
| | 39' | | | | 500 | $1 \times 10^{-5}$ | | 1000 | 96.6 | 195 | 1.51 | 180 |
| | 40' | | | | 700 | $1 \times 10^{-2}$ | | 1000 | 96.5 | 190 | 1.50 | 175 |
| | 41' | | | | 900 | $1 \times 10^{-1}$ | | 1000 | 96.5 | 180 | 1.50 | 160 |
| | 42' | | | | 1100 | $1 \times 10^{-1}$ | | 1000 | 96.3 | 180 | 1.48 | 85 |
| | 43' | | | Vacuum | 150 | $1 \times 10^{-12}$ | | 950 | 96.1 | 138 | 1.45 | 95 |
| | 44' | | | | 300 | $1 \times 10^{-8}$ | | 950 | 96.3 | 150 | 1.46 | 160 |
| | 45' | | | Argon | 400 | $1 \times 10^{-6}$ | | 950 | 96.4 | 165 | 1.47 | 185 |
| | 46' | | | | 500 | $1 \times 10^{-5}$ | | 950 | 96.5 | 190 | 1.50 | 190 |
| | 47' | | | | 700 | $1 \times 10^{-2}$ | | 950 | 96.4 | 180 | 1.49 | 185 |
| | 48' | | | | 900 | $1 \times 10^{-1}$ | | 950 | 96.3 | 190 | 1.48 | 170 |
| | 49' | | | | 1100 | $1 \times 10^{-1}$ | | 950 | 96.2 | 165 | 1.47 | 90 |
| Comparative method | 16' | | | Vacuum | 120* | $1 \times 10^{-12}$ | | 1000 | 96.2 | 120 | 1.46 | 10 |
| | 17' | | | Argon | 1150* | $1 \times 10^{-1}$ | | 1000 | 96.0 | 160 | 1.44 | 19 |
| | 18' | | | | 1100 | $1 \times 10^{0}$* | | 1000 | 96.3 | 70 | 1.47 | 1.5 |
| | 19' | | | Vacuum | 120* | $1 \times 10^{-12}$ | | 950 | 96.0 | 105 | 1.44 | 15 |
| | 20' | | | Argon | 1150* | $1 \times 10^{-1}$ | | 950 | 95.8 | 140 | 1.42 | 23 |
| | 21' | | | | 1100 | $1 \times 10^{0}$* | | 950 | 96.1 | 80 | 1.45 | 1.7 |
| Conventional method | 5' | | Mg ferrite: 1.7 | — | — | — | — | 1000 | 94.0 | 20 | 1.38 | 0.6 |

*indicates a value outside the range of the present invention

As can be seen from the results shown in Tables 9 and 10, the composite soft magnetic materials produced by the present methods 29 to 35 and 36' to 49' have excellent properties with respect to flexural strength, magnetic flux density and resistivity, as compared to the composite soft magnetic materials produced by the conventional methods 5 and 5'. On the other hand, the composite soft magnetic materials produced by the comparative methods 13 to 15 and 16' to 21' have poor properties with respect to relative density and magnetic flux density.

Example 6

Present methods 36 to 42 and comparative methods 16 to 18 were performed as follows. To soft magnetic powder F (an Fe—Si—Al iron-based soft magnetic alloy powder), which had been subjected to oxidation treatment under conditions as indicated in Table 11, was added a Mg powder in an amount as indicated in Table 11. Then, the resulting powder was subjected to tumbling in an argon gas or vacuum atmosphere while maintaining the pressure and temperature indicated in Table 11, thereby obtaining a soft magnetic metal powder coated with a Mg-containing oxide film.

The obtained soft magnetic metal powder coated with a Mg-containing oxide film was placed in a mold, and subjected to press molding to obtain a plate-shaped compacted powder article having a size of 55 mm (length)×10 mm (width)×5 mm (thickness) and a ring-shaped compacted powder article having an outer diameter of 35 mm, an inner diameter of 25 mm and a height of 5 mm. Then, the obtained compacted powder articles were sintered in a nitrogen atmosphere while maintaining the temperature as indicated in Table 11 for 30 minutes, thereby obtaining composite soft magnetic materials, which were a plate-shaped sintered article and a ring-shaped sintered article. With respect to the plate-shaped sintered articles obtained in present methods 36 to 42 and comparative methods 16 to 18, the relative density, resistivity and flexural strength were measured. The results are shown in Table 11. Further, coils were wound around the ring-shaped sintered articles obtained in present methods 36 to 42 and comparative methods 16 to 18, and the magnetic flux density was measured using a BH tracer. The results are shown in Table 11.

Conventional Example 6

Conventional method 6 was performed as follows. To the soft magnetic powder F prepared in the examples was added a Mg ferrite powder in an amount indicated in Table 11, followed by stirring in air while tumbling, to thereby obtain a mixed powder. The obtained mixed powder was placed in a mold, and subjected to press molding to obtain a plate-shaped compacted powder article having a size of 55 mm (length)×10 mm (width)×5 mm (thickness) and a ring-shaped compacted powder article having an outer diameter of 35 mm, an inner diameter of 25 mm and a height of 5 mm. Then, the obtained compacted powder articles were sintered in a nitrogen atmosphere while maintaining the temperature as indicated in Table 11 for 30 minutes, thereby obtaining composite soft magnetic materials, which were a plate-shaped sintered article and a ring-shaped sintered article. With respect to the plate-shaped sintered article obtained in conventional method 6, the relative density, resistivity and flexural strength were measured. The results are shown in Table 11. Further, a coil was wound around the ring-shaped sintered article obtained in conventional method 6, and the magnetic flux density was measured using a BH tracer. The results are shown in Table 11.

TABLE 11

| Type of method | | Soft magnetic powder | Conditions for oxidation treatment | Amount of Mg or Mg ferrite added (% by Mass) | Conditions for forming Mg-containing oxide film by tumbling: Atmosphere | Temperature (° C.) | Pressure (MPa) | Sintering temperature (° C.) | Properties of composite soft magnetic material: Relative density (%) | Flexural Strength (MPa) | Magnetic flux density $B_{10KA/m}$ (T) | Resistivity (μΩm) |
|---|---|---|---|---|---|---|---|---|---|---|---|---|
| Present method | 36 | F | $O_2$: 30%, Ar: 70% 100° C. | Mg: 0.7 | Vacuum | 150 | $1 \times 10^{-12}$ | 900 | 98.1 | 160 | 1.48 | 90 |
| | 37 | | | | | 300 | $1 \times 10^{-8}$ | 900 | 98.2 | 175 | 1.50 | 165 |
| | 38 | | | | Argon | 400 | $1 \times 10^{-6}$ | 900 | 98.3 | 185 | 1.51 | 170 |
| | 39 | | | | | 500 | $1 \times 10^{-5}$ | 900 | 98.3 | 190 | 1.51 | 180 |
| | 40 | | | | | 700 | $1 \times 10^{-2}$ | 900 | 98.1 | 180 | 1.48 | 185 |
| | 41 | | | | | 900 | $1 \times 10^{-1}$ | 900 | 98.1 | 175 | 1.48 | 170 |
| | 42 | | | | | 1100 | $1 \times 10^{-1}$ | 900 | 98.0 | 160 | 1.46 | 105 |
| Comparative method | 16 | | | | Vacuum | 120* | $1 \times 10^{-12}$ | 900 | 98.0 | 155 | 1.45 | 12 |
| | 17 | | | | Argon | 1150* | $1 \times 10^{-1}$ | 900 | 97.9 | 150 | 1.42 | 15 |
| | 18 | | | | | 1100 | $1 \times 10^{0}$* | 900 | 98.3 | 55 | 1.50 | 4 |
| Conventional method 6 | | | — | Mg ferrite: 1.2 | — | — | — | 900 | 97.3 | 18 | 1.36 | 0.8 |

*indicates a value outside the range of the present invention

Another Embodiment of Example 6

Present methods 50' to 56', comparative methods 22' to 24', and conventional method 6' were performed as follows. To a raw powder material F (an Fe—Si—Al iron-based soft magnetic alloy powder) was added a Mg powder in an amount as indicated in Table 12, which is the same as Example 6, and the resulting powder was subjected to tumbling in an argon gas or vacuum atmosphere while maintaining the pressure and temperature indicated in Table 12. Then, the resultant was subjected to oxidation treatment under conditions as indicated in Table 12, thereby obtaining a soft magnetic metal powder coated with a Mg-containing oxide film.

The results of present methods 50' to 56', comparative methods 22' to 24', and conventional method 6' are shown in Table 12.

TABLE 12

| Type of method | | Raw powder material | Amount of Mg or Mg ferrite added (% by Mass) | Conditions for heat tumbling of raw powder material and Mg powder: Atmosphere | Temperature (° C.) | Pressure (MPa) | Conditions for oxidation treatment | Sintering temperature (° C.) | Properties of composite soft magnetic material: Relative density (%) | Flexural Strength (MPa) | Magnetic flux density $B_{10KA/m}$ (T) | Resistivity (μΩm) |
|---|---|---|---|---|---|---|---|---|---|---|---|---|
| Present | 50' | F | Mg: 0.7 | Vacuum | 150 | $1 \times 10^{-12}$ | $O_2$: 30%, | 900 | 98.2 | 165 | 1.49 | 80 |
| method | 51' | | | | 300 | $1 \times 10^{-8}$ | $N_2$: 70% | 900 | 98.2 | 175 | 1.50 | 165 |
| | 52' | | | Argon | 400 | $1 \times 10^{-6}$ | 100° C. | 900 | 98.3 | 185 | 1.51 | 170 |
| | 53' | | | | 500 | $1 \times 10^{-5}$ | | 900 | 98.3 | 190 | 1.51 | 180 |
| | 54' | | | | 700 | $1 \times 10^{-2}$ | | 900 | 98.1 | 180 | 1.48 | 185 |
| | 55' | | | | 900 | $1 \times 10^{-1}$ | | 900 | 98.1 | 175 | 1.48 | 170 |
| | 56' | | | | 1100 | $1 \times 10^{-1}$ | | 900 | 98.0 | 160 | 1.46 | 105 |
| Comparative | 22' | | | Vacuum | 120* | $1 \times 10^{-12}$ | | 900 | 98.0 | 155 | 1.45 | 12 |
| method | 23' | | | Argon | 1150* | $1 \times 10^{-1}$ | | 900 | 97.9 | 150 | 1.42 | 15 |
| | 24' | | | | 1100 | $1 \times 10^{0}$* | | 900 | 98.3 | 55 | 1.50 | 4 |
| Conventional method 6' | | | Mg ferrite: 1.2 | — | — | — | — | 900 | 97.3 | 18 | 1.36 | 0.8 |

*indicates a value outside the range of the present invention

As can be seen from the results shown in Tables 11 and 12, the composite soft magnetic materials produced by the present methods 36 to 42 and 50' to 56' have excellent properties with respect to flexural strength, magnetic flux density and resistivity, as compared to the composite soft magnetic materials produced by the conventional methods 6 and 6'. On the other hand, the composite soft magnetic materials produced by the comparative methods 16 to 18 and 22' to 24' have poor properties with respect to relative density and magnetic flux density.

Example 7

Present methods 43 to 49 and comparative methods 19 to 21 were performed as follows. To soft magnetic powder G (an Fe—Co—V iron-based soft magnetic alloy powder), which had been subjected to oxidation treatment under conditions as indicated in Table 13, was added a Mg powder in an amount as indicated in Table 13. Then, the resulting powder was subjected to tumbling in an argon gas or vacuum atmosphere while maintaining the pressure and temperature indicated in Table 13, thereby obtaining a soft magnetic metal powder coated with a Mg-containing oxide film.

Conventional Example 7

Conventional method 7 was performed as follows. To the soft magnetic powder G prepared in the examples was added a Mg ferrite powder in an amount indicated in Table 13, followed by stirring in air while tumbling, to thereby obtain a mixed powder. The obtained mixed powder was placed in a mold, and subjected to press molding to obtain a plate-shaped compacted powder article having a size of 55 mm (length)×10 mm (width)×5 mm (thickness) and a ring-shaped compacted powder article having an outer diameter of 35 mm, an inner diameter of 25 mm and a height of 5 mm. Then, the obtained compacted powder articles were sintered in a nitrogen atmosphere while maintaining the temperature as indicated in Table 13 for 30 minutes, thereby obtaining composite soft magnetic materials, which were a plate-shaped sintered article and a ring-shaped sintered article. With respect to the plate-shaped sintered article obtained in conventional method 7, the relative density, resistivity and flexural strength were measured. The results are shown in Table 13. Further, a coil was wound around the ring-shaped sintered article obtained in conventional method 7, and the magnetic flux density was measured using a BH tracer. The results are shown in Table 13.

TABLE 13

| Type of method | | Soft magnetic powder | Conditions for oxidation treatment | Amount of Mg or Mg ferrite added (% by Mass) | Conditions for forming Mg-containing oxide film by tumbling: Atmosphere | Temperature (° C.) | Pressure (MPa) | Sintering temperature (° C.) | Properties of composite soft magnetic material: Relative density (%) | Flexural Strength (MPa) | Magnetic flux density $B_{10KA/m}$ (T) | Resistivity (μΩm) |
|---|---|---|---|---|---|---|---|---|---|---|---|---|
| Present method | 43 | G | Air 150° C. | Mg: 2 | Vacuum | 150 | $1 \times 10^{-12}$ | 1300 | 94.8 | 180 | 1.68 | 80 |
| | 44 | | | | | 300 | $1 \times 10^{-8}$ | 1300 | 95.2 | 205 | 1.70 | 115 |
| | 45 | | | | Argon | 400 | $1 \times 10^{-6}$ | 1300 | 95.1 | 210 | 1.69 | 120 |
| | 46 | | | | | 500 | $1 \times 10^{-5}$ | 1300 | 95.0 | 200 | 1.69 | 130 |
| | 47 | | | | | 700 | $1 \times 10^{-2}$ | 1300 | 94.9 | 190 | 1.68 | 115 |
| | 48 | | | | | 900 | $1 \times 10^{-1}$ | 1300 | 94.8 | 185 | 1.65 | 115 |
| | 49 | | | | | 1100 | $1 \times 10^{-1}$ | 1300 | 94.5 | 160 | 1.67 | 90 |
| Comparative method | 19 | | | | Vacuum | 120* | $1 \times 10^{-12}$ | 1300 | 94.8 | 110 | 1.65 | 10 |
| | 20 | | | | Argon | 1150* | $1 \times 10^{-1}$ | 1300 | 94.0 | 125 | 1.60 | 15 |
| | 21 | | | | | 1100 | $1 \times 10^{0}$* | 1300 | 94.5 | 170 | 1.62 | 3 |
| Conventional method 7 | | | — | Mg ferrite: 3.33 | — | — | — | 1300 | 95.0 | 175 | 1.65 | 0.3 |

*indicates a value outside the range of the present invention

The obtained soft magnetic metal powder coated with a Mg-containing oxide film was placed in a mold, and subjected to press molding to obtain a plate-shaped compacted powder article having a size of 55 mm (length)×10 mm (width)×5 mm (thickness) and a ring-shaped compacted powder article having an outer diameter of 35 mm, an inner diameter of 25 mm and a height of 5 mm. Then, the obtained compacted powder articles were sintered in a nitrogen atmosphere while maintaining the temperature as indicated in Table 13 for 30 minutes, thereby obtaining composite soft magnetic materials, which were a plate-shaped sintered article and a ring-shaped sintered article. With respect to the plate-shaped sintered articles obtained in present methods 43 to 49 and comparative methods 19 to 21, the relative density, resistivity and flexural strength were measured. The results are shown in Table 13. Further, coils were wound around the ring-shaped sintered articles obtained in present methods 43 to 49 and comparative methods 19 to 21, and the magnetic flux density was measured using a BH tracer. The results are shown in Table 13.

Another Embodiment of Example 7

Present methods 57' to 70', comparative methods 25' to 30', and conventional method 7' were performed as follows. To a raw powder material G (an Fe—Co—V iron-based soft magnetic alloy powder) was added a Mg powder in an amount as indicated in Table 14, which is the same as Example 7, and the resulting powder was subjected to tumbling in an argon gas or vacuum atmosphere while maintaining the pressure and temperature indicated in Table 14. Then, the resultant was subjected to oxidation treatment under conditions as indicated in Table 14, thereby obtaining a soft magnetic metal powder coated with a Mg-containing oxide film.

The results of present methods 57' to 70', comparative methods 25' to 30', and conventional method 7' are shown in Table 14.

TABLE 14

| Type of method | Raw powder material | Amount of Mg or Mg ferrite added (% by Mass) | Conditions for heat tumbling of raw powder material and Mg powder: Atmosphere | Temperature (° C.) | Pressure (MPa) | Conditions for oxidation treatment | Sintering temperature (° C.) | Properties of composite soft magnetic material: Relative density (%) | Flexural Strength (MPa) | Magnetic flux density $B_{10KA/m}$ (T) | Resistivity (μΩm) |
|---|---|---|---|---|---|---|---|---|---|---|---|
| Present method | 57' G | Mg: 2 | Vacuum | 150 | $1 \times 10^{-12}$ | Air 150° C. | 1300 | 94.8 | 180 | 1.68 | 80 |
| | 58' | | | 300 | $1 \times 10^{-8}$ | | 1300 | 95.2 | 205 | 1.70 | 115 |
| | 59' | | Argon | 400 | $1 \times 10^{-6}$ | | 1300 | 95.2 | 215 | 1.70 | 110 |
| | 60' | | | 500 | $1 \times 10^{-5}$ | | 1300 | 95.0 | 200 | 1.69 | 130 |
| | 61' | | | 700 | $1 \times 10^{-2}$ | | 1300 | 94.9 | 190 | 1.68 | 115 |
| | 62' | | | 900 | $1 \times 10^{-1}$ | | 1300 | 94.8 | 185 | 1.67 | 115 |
| | 63' | | | 1100 | $1 \times 10^{-1}$ | | 1300 | 94.5 | 160 | 1.65 | 90 |
| | 64' | | Vacuum | 150 | $1 \times 10^{-12}$ | | 1250 | 94.5 | 170 | 1.67 | 100 |
| | 65' | | | 300 | $1 \times 10^{-8}$ | | 1250 | 94.7 | 190 | 1.67 | 110 |
| | 66' | | Argon | 400 | $1 \times 10^{-6}$ | | 1250 | 95.0 | 210 | 1.68 | 100 |
| | 67' | | | 500 | $1 \times 10^{-5}$ | | 1250 | 95.2 | 210 | 1.70 | 150 |
| | 68' | | | 700 | $1 \times 10^{-2}$ | | 1250 | 95.1 | 180 | 1.69 | 120 |
| | 69' | | | 900 | $1 \times 10^{-1}$ | | 1250 | 95.0 | 180 | 1.69 | 150 |
| | 70' | | | 1100 | $1 \times 10^{-1}$ | | 1250 | 94.6 | 170 | 1.66 | 120 |
| Comparative method | 25' | | Vacuum | 120* | $1 \times 10^{-12}$ | | 1300 | 94.8 | 110 | 1.67 | 10 |
| | 26' | | Argon | 1150* | $1 \times 10^{-1}$ | | 1300 | 94.0 | 125 | 1.60 | 15 |
| | 27' | | | 1100 | $1 \times 10^{0}$* | | 1300 | 94.5 | 170 | 1.62 | 3 |
| | 28' | | Vacuum | 120* | $1 \times 10^{-12}$ | | 1250 | 94.6 | 120 | 1.65 | 10 |
| | 29' | | Argon | 1150* | $1 \times 10^{-1}$ | | 1250 | 93.8 | 135 | 1.58 | 10 |
| | 30' | | | 1100 | $1 \times 10^{0}$* | | 1250 | 98.3 | 180 | 1.59 | 5 |
| Conventional method | 7' | Mg ferrite: 3.33 | — | — | — | — | 1300 | 95.0 | 175 | 1.65 | 0.3 |

*indicates a value outside the range of the present invention

As can be seen from the results shown in Tables 13 and 14, the composite soft magnetic materials produced by the present methods 43 to 49 and 57' to 70' have excellent properties with respect to flexural strength, magnetic flux density and resistivity, as compared to the composite soft magnetic materials produced by the conventional methods 7 and 7'. On the other hand, the composite soft magnetic materials produced by the comparative methods 19 to 21 and 25' to 30' have poor properties with respect to relative density and magnetic flux density.

Example 8

Present methods 50 to 56 and comparative methods 22 to 24 were performed as follows. To soft magnetic powder H (an Fe—P iron-based soft magnetic alloy powder), which had been subjected to oxidation treatment under conditions as indicated in Table 15, was added a Mg powder in an amount as indicated in Table 15. Then, the resulting powder was subjected to tumbling in an argon gas or vacuum atmosphere while maintaining the pressure and temperature indicated in Table 15, thereby obtaining a soft magnetic metal powder coated with a Mg-containing oxide film.

The obtained soft magnetic metal powder coated with a Mg-containing oxide film was placed in a mold, and subjected to press molding to obtain a plate-shaped compacted powder article having a size of 55 mm (length)×10 mm (width)×5 mm (thickness) and a ring-shaped compacted powder article having an outer diameter of 35 mm, an inner diameter of 25 mm and a height of 5 mm. Then, the obtained compacted powder articles were sintered in a nitrogen atmosphere while maintaining the temperature as indicated in Table 15 for 30 minutes, thereby obtaining composite soft magnetic materials, which were a plate-shaped sintered article and a ring-shaped sintered article. With respect to the plate-shaped sintered articles obtained in present methods 50 to 56 and comparative methods 22 to 24, the relative density, resistivity and flexural strength were measured. The results are shown in Table 15. Further, coils were wound around the ring-shaped sintered articles obtained in present methods 50 to 56 and comparative methods 22 to 24, and the magnetic flux density was measured using a BH tracer. The results are shown in Table 15.

Conventional Example 8

Conventional method 8 was performed as follows. To the soft magnetic powder H prepared in the examples was added a Mg ferrite powder in an amount indicated in Table 15, followed by stirring in air while tumbling, to thereby obtain a mixed powder. The obtained mixed powder was placed in a mold, and subjected to press molding to obtain a plate-shaped compacted powder article having a size of 55 mm (length)×10 mm (width)×5 mm (thickness) and a ring-shaped compacted powder article having an outer diameter of 35 mm, an inner diameter of 25 mm and a height of 5 mm. Then, the obtained compacted powder articles were sintered in a nitrogen atmosphere while maintaining the temperature as indicated in Table 15 for 30 minutes, thereby obtaining composite soft magnetic materials, which were a plate-shaped sintered article and a ring-shaped sintered article. With respect to the plate-shaped sintered article obtained in conventional method 8, the relative density, resistivity and flexural strength were measured. The results are shown in Table 15. Further, a coil was wound around the ring-shaped sintered article obtained in conventional method 8, and the magnetic flux density was measured using a BH tracer. The results are shown in Table 15.

TABLE 15

| Type of method | | Soft magnetic powder | Conditions for oxidation treatment | Amount of Mg or Mg ferrite added (% by Mass) | Conditions for forming Mg-containing oxide film by tumbling: Atmosphere | Temperature (° C.) | Pressure (MPa) | Sintering temperature (° C.) | Properties of composite soft magnetic material: Relative density (%) | Flexural Strength (MPa) | Magnetic flux density $B_{10KA/m}$ (T) | Resistivity (μΩm) |
|---|---|---|---|---|---|---|---|---|---|---|---|---|
| Present method | 50 | H | $O_2$: 10%, Ar: 90% 100° C. | Mg: 0.5 | Vacuum | 150 | $1 \times 10^{-12}$ | 400 | 98.3 | 165 | 1.65 | 70 |
| | 51 | | | | | 300 | $1 \times 10^{-8}$ | 400 | 98.5 | 170 | 1.68 | 125 |
| | 52 | | | | Argon | 400 | $1 \times 10^{-6}$ | 400 | 98.5 | 185 | 1.68 | 160 |
| | 53 | | | | | 500 | $1 \times 10^{-5}$ | 400 | 98.6 | 185 | 1.69 | 175 |
| | 54 | | | | | 700 | $1 \times 10^{-2}$ | 400 | 98.6 | 180 | 1.69 | 165 |
| | 55 | | | | | 900 | $1 \times 10^{-1}$ | 400 | 98.7 | 170 | 1.70 | 140 |
| | 56 | | | | | 1100 | $1 \times 10^{-1}$ | 400 | 98.4 | 160 | 1.66 | 110 |
| Comparative method | 22 | | | | Vacuum | 120* | $1 \times 10^{-12}$ | 400 | 98.2 | 155 | 1.62 | 12 |
| | 23 | | | | Argon | 1150* | $1 \times 10^{-1}$ | 400 | 98.4 | 170 | 1.66 | 15 |
| | 24 | | | | | 1100 | $1 \times 10^{0}$* | 400 | 98.5 | 90 | 1.67 | 2 |
| Conventional method 8 | | | — | Mg ferrite: 0.85 | — | — | — | 400 | 98.1 | 27 | 1.61 | 0.25 |

*indicates a value outside the range of the present invention

Another Embodiment of Example 8

Present methods 71' to 84', comparative methods 31' to 36', and conventional method 8' were performed as follows. To a raw powder material H (an Fe—P iron-based soft magnetic alloy powder) was added a Mg powder in an amount as indicated in Table 16, which is the same as Example 8, and the resulting powder was subjected to tumbling in an argon gas or vacuum atmosphere while maintaining the pressure and temperature indicated in Table 16. Then, the resultant was subjected to oxidation treatment under conditions as indicated in Table 16, thereby obtaining a soft magnetic metal powder coated with a Mg-containing oxide film.

The results of present methods 71' to 84', comparative methods 31' to 36', and conventional method 8' are shown in Table 16.

TABLE 16

| Type of method | | Raw powder material | Amount of Mg or Mg ferrite added (% by Mass) | Conditions for heat tumbling of raw powder material and Mg powder: Atmosphere | Temperature (° C.) | Pressure (MPa) | Conditions for oxidation treatment | Sintering temperature (° C.) | Properties of composite soft magnetic material: Relative density (%) | Flexural Strength (MPa) | Magnetic flux density $B_{10KA/m}$ (T) | Resistivity (μΩm) |
|---|---|---|---|---|---|---|---|---|---|---|---|---|
| Present method | 71' | H | Mg: 0.5 | Vacuum | 150 | $1 \times 10^{-12}$ | $O_2$: 10%, Ar: 90% 100° C. | 400 | 98.3 | 165 | 1.65 | 70 |
| | 72' | | | | 300 | $1 \times 10^{-8}$ | | 400 | 98.5 | 170 | 1.68 | 125 |
| | 73' | | | Argon | 400 | $1 \times 10^{-6}$ | | 400 | 98.5 | 185 | 1.68 | 160 |
| | 74' | | | | 500 | $1 \times 10^{-5}$ | | 400 | 98.6 | 185 | 1.69 | 175 |
| | 75' | | | | 700 | $1 \times 10^{-2}$ | | 400 | 98.6 | 180 | 1.69 | 165 |
| | 76' | | | | 900 | $1 \times 10^{-1}$ | | 400 | 98.7 | 170 | 1.70 | 140 |
| | 77' | | | | 1100 | $1 \times 10^{-1}$ | | 400 | 98.4 | 160 | 1.66 | 110 |
| | 78' | | | Vacuum | 150 | $1 \times 10^{-12}$ | | 450 | 98.4 | 170 | 1.66 | 68 |
| | 79' | | | | 300 | $1 \times 10^{-8}$ | | 450 | 98.6 | 175 | 1.68 | 120 |
| | 80' | | | Argon | 400 | $1 \times 10^{-6}$ | | 450 | 98.6 | 190 | 1.68 | 155 |
| | 81' | | | | 500 | $1 \times 10^{-5}$ | | 450 | 98.7 | 190 | 1.70 | 170 |
| | 82' | | | | 700 | $1 \times 10^{-2}$ | | 450 | 98.7 | 185 | 1.69 | 160 |
| | 83' | | | | 900 | $1 \times 10^{-1}$ | | 450 | 98.7 | 173 | 1.70 | 137 |
| | 84' | | | | 1100 | $1 \times 10^{-1}$ | | 450 | 98.5 | 165 | 1.67 | 105 |
| Comparative method | 31' | | | Vacuum | 120* | $1 \times 10^{-12}$ | | 400 | 98.2 | 155 | 1.62 | 12 |
| | 32' | | | Argon | 1150* | $1 \times 10^{-1}$ | | 400 | 98.4 | 170 | 1.66 | 15 |
| | 33' | | | | 1100 | $1 \times 10^{-0}$* | | 400 | 98.5 | 90 | 1.67 | 2 |
| | 34' | | | Vacuum | 120* | $1 \times 10^{-12}$ | | 450 | 98.3 | 160 | 1.63 | 10 |
| | 35' | | | Argon | 1150* | $1 \times 10^{-1}$ | | 450 | 98.5 | 180 | 1.66 | 12 |
| | 36' | | | | 1100 | $1 \times 10^{-0}$* | | 450 | 98.6 | 95 | 1.68 | 1.7 |
| Conventional method | 8' | | Mg ferrite: 0.85 | — | — | — | — | 400 | 98.1 | 27 | 1.61 | 0.25 |

*indicates a value outside the range of the present invention

As can be seen from the results shown in Tables 15 and 16, the composite soft magnetic materials produced by the present methods 50 to 56 and 71' to 84' have excellent properties with respect to flexural strength, magnetic flux density and resistivity, as compared to the composite soft magnetic materials produced by the conventional methods 8 and 8'. On the other hand, the composite soft magnetic materials produced by the comparative methods 22 to 24 and 31' to 36' have poor properties with respect to relative density and magnetic flux density.

Example 9

Present methods 57 to 63 and comparative methods 25 to 27 were performed as follows. To soft magnetic powder I (a phosphate-coated iron powder), which had been subjected to oxidation treatment under conditions as indicated in Table 17, was added a Mg powder in an amount as indicated in Table 17. Then, the resulting powder was subjected to tumbling in an argon gas or vacuum atmosphere while maintaining the pressure and temperature indicated in Table 17, thereby obtaining a soft magnetic metal powder coated with a Mg-containing oxide film.

The obtained soft magnetic metal powder coated with a Mg-containing oxide film was placed in a mold, and subjected to press molding to obtain a plate-shaped compacted powder article having a size of 55 mm (length)×10 mm (width)×5 mm (thickness) and a ring-shaped compacted powder article having an outer diameter of 35 mm, an inner diameter of 25 mm and a height of 5 mm. Then, the obtained compacted powder articles were sintered in a nitrogen atmosphere while maintaining the temperature as indicated in Table 17 for 30 minutes, thereby obtaining composite soft magnetic materials, which were a plate-shaped sintered article and a ring-shaped sintered article. With respect to the plate-shaped sintered articles obtained in present methods 57 to 63 and comparative methods 25 to 27, the relative density, resistivity and flexural strength were measured. The results are shown in Table 17. Further, coils were wound around the ring-shaped sintered articles obtained in present methods 57 to 63 and comparative methods 25 to 27, and the magnetic flux density was measured using a BH tracer. The results are shown in Table 17.

Conventional Example 9

Conventional method 9 was performed as follows. To the soft magnetic powder I prepared in the examples was added a Mg ferrite powder in an amount indicated in Table 17, followed by stirring in air while tumbling, to thereby obtain a mixed powder. The obtained mixed powder was placed in a mold, and subjected to press molding to obtain a plate-shaped compacted powder article having a size of 55 mm (length)×10 mm (width)×5 mm (thickness) and a ring-shaped compacted powder article having an outer diameter of 35 mm, an inner diameter of 25 mm and a height of 5 mm. Then, the obtained compacted powder articles were sintered in a nitrogen atmosphere while maintaining the temperature as indicated in Table 17 for 30 minutes, thereby obtaining composite soft magnetic materials, which were a plate-shaped sintered article and a ring-shaped sintered article. With respect to the plate-shaped sintered article obtained in conventional method 9, the relative density, resistivity and flexural strength were measured. The results are shown in Table 17. Further, a coil was wound around the ring-shaped sintered article obtained in conventional method 9, and the magnetic flux density was measured using a BH tracer. The results are shown in Table 17.

TABLE 17

| Type of method | | Soft magnetic powder | Conditions for oxidation treatment | Amount of Mg or Mg ferrite added (% by Mass) | Conditions for forming Mg-containing oxide film by tumbling: Atmosphere | Temperature (° C.) | Pressure (MPa) | Sintering temperature (° C.) | Properties of composite soft magnetic material: Relative density (%) | Flexural Strength (MPa) | Magnetic flux density $B_{10KA/m}$ (T) | Resistivity (μΩm) |
|---|---|---|---|---|---|---|---|---|---|---|---|---|
| Present method | 57 | I | $O_2$: 10%, Ar: 90% 100° C. | Mg: 0.5 | Vacuum | 150 | $1 \times 10^{-12}$ | 600 | 98.3 | 165 | 1.65 | 70 |
| | 58 | | | | | 300 | $1 \times 10^{-8}$ | 600 | 98.5 | 170 | 1.68 | 125 |
| | 59 | | | | Argon | 400 | $1 \times 10^{-6}$ | 600 | 98.5 | 180 | 1.68 | 180 |
| | 60 | | | | | 500 | $1 \times 10^{-5}$ | 600 | 98.6 | 180 | 1.69 | 185 |
| | 61 | | | | | 700 | $1 \times 10^{-2}$ | 600 | 98.6 | 185 | 1.69 | 180 |
| | 62 | | | | | 900 | $1 \times 10^{-1}$ | 600 | 98.7 | 170 | 1.70 | 160 |
| | 63 | | | | | 1100 | $1 \times 10^{-1}$ | 600 | 98.4 | 160 | 1.66 | 130 |
| Comparative method | 25 | | | | Vacuum | 120* | $1 \times 10^{-12}$ | 600 | 98.2 | 110 | 1.62 | 120 |
| | 26 | | | | Argon | 1150* | $1 \times 10^{-1}$ | 600 | 98.4 | 150 | 1.66 | 14 |
| | 27 | | | | | 1100 | $1 \times 10^{0}$* | 600 | 98.5 | 160 | 1.67 | 20 |
| Conventional method 9 | | | — | Mg ferrite: 0.85 | — | — | — | 60 | 98.1 | 20 | 1.61 | 0.3 |

*indicates a value outside the range of the present invention

Another Embodiment of Example 9

Present methods 85' to 91', comparative methods 37' to 39', and conventional method 9' were performed as follows. To a raw powder material I (a phosphate-coated iron powder) was added a Mg powder in an amount as indicated in Table 18, which is the same as Example 9, and the resulting powder was subjected to tumbling in an argon gas or vacuum atmosphere while maintaining the pressure and temperature indicated in Table 18. Then, the resultant was subjected to oxidation treatment under conditions as indicated in Table 18, thereby obtaining a soft magnetic metal powder coated with a Mg-containing oxide film.

The results of present methods 85' to 91', comparative methods 37' to 39', and conventional method 9' are shown in Table 18.

TABLE 18

| Type of method | Raw powder material | Amount of Mg or Mg ferrite added (% by Mass) | Conditions for heat tumbling of raw powder material and Mg powder: Atmosphere | Temperature (° C.) | Pressure (MPa) | Conditions for oxidation treatment | Sintering temperature (° C.) | Properties of composite soft magnetic material: Relative density (%) | Flexural Strength (MPa) | Magnetic flux density $B_{10KA/m}$ (T) | Resistivity (μΩm) |
|---|---|---|---|---|---|---|---|---|---|---|---|
| Present method | 85' I | Mg: 0.5 | Vacuum | 150 | $1 \times 10^{-12}$ | $O_2$: 10%, Ar: 90% 100° C. | 600 | 98.2 | 160 | 1.66 | 70 |
| | 86' | | | 300 | $1 \times 10^{-8}$ | | 600 | 98.3 | 175 | 1.64 | 125 |
| | 87' | | Argon | 400 | $1 \times 10^{-6}$ | | 600 | 98.3 | 170 | 1.64 | 160 |
| | 88' | | | 500 | $1 \times 10^{-5}$ | | 600 | 98.4 | 165 | 1.65 | 170 |
| | 89' | | | 700 | $1 \times 10^{-2}$ | | 600 | 98.4 | 160 | 1.65 | 160 |
| | 90' | | | 900 | $1 \times 10^{-1}$ | | 600 | 98.5 | 160 | 1.66 | 150 |
| | 91' | | | 1100 | $1 \times 10^{-1}$ | | 600 | 98.6 | 170 | 1.66 | 110 |
| Comparative method | 37' | | Vacuum | 120* | $1 \times 10^{-12}$ | | 600 | 98.2 | 160 | 1.64 | 12 |
| | 38' | | Argon | 1150* | $1 \times 10^{-1}$ | | 600 | 98.0 | 150 | 1.60 | 15 |
| | 39' | | | 1100 | $1 \times 10^{0}$* | | 600 | 98.2 | 95 | 1.64 | 2 |
| Conventional method 9' | | Mg ferrite: 0.85 | — | — | — | — | 60 | 98.1 | 20 | 1.61 | 0.3 |

*indicates a value outside the range of the present invention

As can be seen from the results shown in Tables 17 and 18, the composite soft magnetic materials produced by the present methods 57 to 63 and 85' to 91' have excellent properties with respect to flexural strength, magnetic flux density and resistivity, as compared to the composite soft magnetic materials produced by the conventional methods 9 and 9'. On the other hand, the composite soft magnetic materials produced by the comparative methods 25 to 27 and 37' to 39' have poor properties with respect to relative density and magnetic flux density.

Example 10

Present methods 64 to 70 and comparative methods 28 to 30 were performed as follows. To soft magnetic powder J (an Fe—Co iron-based soft magnetic alloy powder), which had been subjected to oxidation treatment under conditions as indicated in Table 19, was added a Mg powder in an amount as indicated in Table 19. Then, the resulting powder was subjected to tumbling in an argon gas or vacuum atmosphere while maintaining the pressure and temperature indicated in Table 19, thereby obtaining a soft magnetic metal powder coated with a Mg-containing oxide film.

The obtained soft magnetic metal powder coated with a Mg-containing oxide film was placed in a mold, and subjected to press molding to obtain a plate-shaped compacted powder article having a size of 55 mm (length)×10 mm (width)×5 mm (thickness) and a ring-shaped compacted powder article having an outer diameter of 35 mm, an inner diameter of 25 mm and a height of 5 mm. Then, the obtained compacted powder articles were sintered in a nitrogen atmosphere while maintaining the temperature as indicated in Table 19 for 30 minutes, thereby obtaining composite soft magnetic materials, which were a plate-shaped sintered article and a ring-shaped sintered article. With respect to the plate-shaped sintered articles obtained in present methods 64 to 70 and comparative methods 28 to 30, the relative density, resistivity and flexural strength were measured. The results are shown in Table 19. Further, coils were wound around the ring-shaped sintered articles obtained in present methods 64 to 70 and comparative methods 28 to 30, and the magnetic flux density was measured using a BH tracer. The results are shown in Table 19.

Conventional Example 10

Conventional method 10 was performed as follows. To the soft magnetic powder I prepared in the examples was added a Mg ferrite powder in an amount indicated in Table 19, followed by stirring in air while tumbling, to thereby obtain a mixed powder. The obtained mixed powder was placed in a mold, and subjected to press molding to obtain a plate-shaped compacted powder article having a size of 55 mm (length)×10 mm (width)×5 mm (thickness) and a ring-shaped compacted powder article having an outer diameter of 35 mm, an inner diameter of 25 mm and a height of 5 mm. Then, the obtained compacted powder articles were sintered in a nitrogen atmosphere while maintaining the temperature as indicated in Table 19 for 30 minutes, thereby obtaining composite soft magnetic materials, which were a plate-shaped sintered article and a ring-shaped sintered article. With respect to the plate-shaped sintered article obtained in conventional method 10, the relative density, resistivity and flexural strength were measured. The results are shown in Table 19. Further, a coil was wound around the ring-shaped sintered article obtained in conventional method 10, and the magnetic flux density was measured using a BH tracer. The results are shown in Table 19.

TABLE 19

| Type of method | | Soft magnetic powder | Conditions for oxidation treatment | Amount of Mg or Mg ferrite added (% by Mass) | Conditions for forming Mg-containing oxide film by tumbling: Atmosphere | Temperature (° C.) | Pressure (MPa) | Sintering temperature (° C.) | Properties of composite soft magnetic material: Relative density (%) | Flexural Strength (MPa) | Magnetic flux density $B_{10KA/m}$ (T) | Resistivity (μΩm) |
|---|---|---|---|---|---|---|---|---|---|---|---|---|
| Present method | 64 | J | $O_2$: 10%, Ar: 90% 100° C. | Mg: 0.5 | Vacuum | 150 | $1 \times 10^{-12}$ | 1300 | 94.7 | 160 | 1.65 | 70 |
| | 65 | | | | | 300 | $1 \times 10^{-8}$ | 1300 | 94.9 | 180 | 1.66 | 100 |
| | 66 | | | | Argon | 400 | $1 \times 10^{-6}$ | 1300 | 94.9 | 190 | 1.67 | 115 |
| | 67 | | | | | 500 | $1 \times 10^{-5}$ | 1300 | 95.0 | 195 | 1.67 | 120 |
| | 68 | | | | | 700 | $1 \times 10^{-2}$ | 1300 | 95.0 | 190 | 1.67 | 115 |
| | 69 | | | | | 900 | $1 \times 10^{-1}$ | 1300 | 95.0 | 180 | 1.67 | 110 |
| | 70 | | | | | 1100 | $1 \times 10^{-1}$ | 1300 | 94.9 | 170 | 1.65 | 85 |
| Comparative method | 28 | | | | Vacuum | 120* | $1 \times 10^{-12}$ | 1300 | 94.6 | 110 | 1.63 | 10 |
| | 29 | | | | Argon | 1150* | $1 \times 10^{-1}$ | 1300 | 94.2 | 120 | 1.60 | 12 |
| | 30 | | | | | 1100 | $1 \times 10^{0}$* | 1300 | 94.2 | 160 | 1.60 | 3 |
| Conventional method 10 | | | — | Mg ferrite: 0.85 | — | — | — | 1300 | 92.0 | 150 | 1.55 | 0.3 |

*indicates a value outside the range of the present invention

Another Embodiment of Example 10

Present methods 92' to 98', comparative methods 40' to 42', and conventional method 10' were performed as follows. To a raw powder material J (an Fe—Co iron-based soft magnetic alloy powder) was added a Mg powder in an amount as indicated in Table 20, which is the same as Example 10, and the resulting powder was subjected to tumbling in an argon gas or vacuum atmosphere while maintaining the pressure and temperature indicated in Table 20. Then, the resultant was subjected to oxidation treatment under conditions as indicated in Table 20, thereby obtaining a soft magnetic metal powder coated with a Mg-containing oxide film.

The results of present methods 92' to 98', comparative methods 40' to 42', and conventional method 10' are shown in Table 20.

TABLE 20

| Type of method | | Raw powder material | Amount of Mg or Mg ferrite added (% by Mass) | Conditions for heat tumbling of raw powder material and Mg: Atmosphere | Temperature (° C.) | Pressure (MPa) | Conditions for oxidation treatment | Sintering temperature (° C.) | Properties of composite soft magnetic material: Relative density (%) | Flexural Strength (MPa) | Magnetic flux density $B_{10KA/m}$ (T) | Resistivity (μΩm) |
|---|---|---|---|---|---|---|---|---|---|---|---|---|
| Present method | 92' | J | Mg: 0.5 | Vacuum | 150 | $1 \times 10^{-12}$ | $O_2$: 10%, Ar: 90% 100° C. | 1300 | 94.9 | 190 | 1.70 | 70 |
| | 93' | | | | 300 | $1 \times 10^{-8}$ | | 1300 | 95.3 | 210 | 1.72 | 105 |
| | 94' | | | Argon | 400 | $1 \times 10^{-6}$ | | 1300 | 95.3 | 220 | 1.72 | 100 |
| | 95' | | | | 500 | $1 \times 10^{-5}$ | | 1300 | 95.1 | 210 | 1.71 | 100 |
| | 96' | | | | 700 | $1 \times 10^{-2}$ | | 1300 | 95.0 | 200 | 1.70 | 105 |
| | 97' | | | | 900 | $1 \times 10^{-1}$ | | 1300 | 94.9 | 190 | 1.69 | 100 |
| | 98' | | | | 1100 | $1 \times 10^{-1}$ | | 1300 | 94.6 | 170 | 1.68 | 80 |
| Comparative method | 40' | | | Vacuum | 120* | $1 \times 10^{-12}$ | | 1300 | 94.9 | 100 | 1.67 | 8 |
| | 41' | | | Argon | 1150* | $1 \times 10^{-1}$ | | 1300 | 94.1 | 110 | 1.60 | 13 |
| | 42' | | | | 1100 | $1 \times 10^{0}$* | | 1300 | 94.6 | 175 | 1.63 | 2 |
| Conventional method 10' | | | Mg ferrite: 0.85 | — | — | — | — | 1300 | 92.0 | 150 | 1.55 | 0.3 |

*indicates a value outside the range of the present invention

As can be seen from the results shown in Tables 19 and 20, the composite soft magnetic materials produced by the present methods 64 to 70 and 92' to 98' have excellent properties with respect to flexural strength, magnetic flux density and resistivity, as compared to the composite soft magnetic materials produced by the conventional methods 10 and 10'. On the other hand, the composite soft magnetic materials produced by the comparative methods 28 to 30 and 40' to 42' have poor properties with respect to relative density and magnetic flux density.

Next, examples of further embodiments are described.

As a soft magnetic raw powder material, the following powders, each having an average particle diameter of 70 μm, were prepared:

a pure iron powder, an atomized Fe—Al iron-based soft magnetic alloy powder including 10% by mass of Al and the remainder containing Fe, an atomized Fe—Ni iron-based soft magnetic alloy powder including 49% by mass of Ni and the remainder containing Fe, an atomized Fe—Cr iron-based soft magnetic alloy powder including 10% by mass of Cr and the remainder containing Fe, an atomized Fe—Si iron-based soft magnetic alloy powder including 3% by mass of Si and the remainder containing Fe, an atomized Fe—Si—Al iron-based soft magnetic alloy powder including 3% by mass of Si, 3% by mass of Al, and the remainder containing Fe, and an atomized Fe—Co—V iron-based soft magnetic alloy powder including 30% by mass of Co, 2% by mass of V, and the remainder containing Fe. These soft magnetic powders were maintained in air at a temperature of 220° C. for 1 hour, thereby obtaining oxide-coated soft magnetic powders having an iron oxide film formed on the surface thereof, which were used as raw powder materials. Separately from the above, a SiO powder having an average particle diameter of 10 μm and a Mg powder having an average particle diameter of 50 μm were prepared.

Example 11

To each of the prepared raw powder materials, which are pure iron powder and oxide-coated soft magnetic powders, was added and mixed a SiO powder in an amount such that the oxide-coated soft magnetic powder:SiO powder ratio became 99.9% by mass:0.1% by mass, to thereby obtain mixed powders. The obtained mixed powders were maintained at a temperature of 650° C., under a pressure of $2.7\times10^{-4}$ MPa, for 3 hours, thereby obtaining soft magnetic powders coated with silicon oxide, which have a silicon oxide film formed on the surface thereof. It was confirmed that the silicon oxide film formed on the surface of the soft magnetic powders coated with silicon oxide was a film containing SiOx (wherein x=1 to 2). Then, to each of the soft magnetic powders coated with silicon oxide was added a Mg powder in an amount such that the soft magnetic powder coated with silicon oxide:Mg powder ratio became 99.8% by mass:0.2% by mass, to thereby obtain mixed powders. The obtained mixed powders were maintained at a temperature of 650° C., under a pressure of $2.7\times10^{-4}$ MPa, for 1 hour, thereby obtaining soft magnetic powders coated with a Mg—Si-containing oxide film which have, formed on the surface thereof, an oxide film containing Mg and Si.

Subsequently, each of the soft magnetic powders coated with a Mg—Si-containing oxide film was placed in a mold, and subjected to press molding to obtain a plate-shaped compacted powder article having a size of 55 mm (length)×10 mm (width)×5 mm (thickness) and a ring-shaped compacted powder article having an outer diameter of 35 mm, an inner diameter of 25 mm and a height of 5 mm. Then, the obtained compacted powder articles were sintered in a nitrogen atmosphere while maintaining the temperature at 600° C. for 30 minutes, thereby obtaining composite soft magnetic materials, which were plate-shaped sintered articles and ring-shaped sintered articles. With respect to the plate-shaped sintered articles, the resistivity was measured. The results are shown in Table 21. Further, coils were wound around the ring-shaped sintered articles, and the magnetic flux density, coercivity, iron loss at a magnetic flux density of 1.5 T and a frequency of 50 Hz, and iron loss at a magnetic flux density of 1.0 T and a frequency of 400 Hz were measured. The results are shown in Table 21.

Example 12

To each of the prepared raw powder materials, which are pure iron powder and oxide-coated soft magnetic powders, was added and mixed a SiO powder and a Mg powder in amounts such that the oxide-coated soft magnetic powder: SiO powder:Mg powder ratio became 99.7% by mass:0.1% by mass:0.2% by mass, to thereby obtain mixed powders. The obtained mixed powders were maintained at a temperature of 650° C., under a pressure of $2.7\times10^{-4}$ MPa, for 3 hours, thereby obtaining soft magnetic powders coated with a Mg—Si-containing oxide film, which have an oxide film containing Mg and Si formed on the surface thereof.

Subsequently, each of the soft magnetic powders coated with a Mg—Si-containing oxide film was placed in a mold, and subjected to press molding to obtain a plate-shaped compacted powder article having a size of 55 mm (length)×10 mm (width)×5 mm (thickness) and a ring-shaped compacted powder article having an outer diameter of 35 mm, an inner diameter of 25 mm and a height of 5 mm. Then, the obtained compacted powder articles were sintered in a nitrogen atmosphere while maintaining the temperature at 600° C. for 30 minutes, thereby obtaining composite soft magnetic materials, which were plate-shaped sintered articles and ring-shaped sintered articles. With respect to the plate-shaped sintered articles, the resistivity was measured. The results are shown in Table 21. Further, coils were wound around the ring-shaped sintered articles, and the magnetic flux density, coercivity, iron loss at a magnetic flux density of 1.5 T and a frequency of 50 Hz, and iron loss at a magnetic flux density of 1.0 T and a frequency of 400 Hz were measured. The results are shown in Table 22.

Example 13

To each of the prepared raw powder materials, which are pure iron powder and oxide-coated soft magnetic powders, was added and mixed a Mg powder in an amount such that the oxide-coated soft magnetic powder:Mg powder ratio became 99.8% by mass:0.2% by mass, to thereby obtain mixed powders. The obtained mixed powders were maintained at a temperature of 650° C., under a pressure of $2.7\times10^{-4}$ MPa, for 2 hours, thereby obtaining soft magnetic powders coated with MgO, which had a MgO film formed on the surface thereof. Then, to each of the soft magnetic powders coated with MgO was added a SiO powder in an amount such that the MgO-coated soft magnetic powder:SiO powder ratio became 99.9% by mass:0.1% by mass, to thereby obtain mixed powders. The obtained mixed powders were maintained at a temperature of 650° C., under a pressure of $2.7\times10^{-4}$ MPa, for 3 hours to form an oxide film containing Mg and Si on a surface of the soft magnetic powders, thereby obtaining soft magnetic powders coated with a Mg—Si-containing oxide film.

Subsequently, each of the soft magnetic powders coated with a Mg—Si-containing oxide film was placed in a mold, and subjected to press molding to obtain a plate-shaped compacted powder article having a size of 55 mm (length)×10 mm (width)×5 mm (thickness) and a ring-shaped compacted powder article having an outer diameter of 35 mm, an inner diameter of 25 mm and a height of 5 mm. Then, the obtained compacted powder articles were sintered in a nitrogen atmosphere while maintaining the temperature at 600° C. for 30 minutes, thereby obtaining composite soft magnetic materials, which were plate-shaped sintered articles and ring-shaped sintered articles. With respect to the plate-shaped sintered articles, the resistivity was measured. The results are shown in Table 21. Further, coils were wound around the ring-shaped sintered articles, and the magnetic flux density, coercivity, iron loss at a magnetic flux density of 1.5 T and a frequency of 50 Hz, and iron loss at a magnetic flux density of 1.0 T and a frequency of 400 Hz were measured. The results are shown in Table 23.

Conventional Example 11

Water-atomized, pure soft magnetic powders prepared in advance were individually mixed with a silicone resin and a MgO powder in amounts such that the water-atomized, pure soft magnetic powder: silicone resin:MgO powder became 99.8:0.14:0.06 to obtain conventional mixed powders. Subsequently, each of the conventional mixed powders was placed in a mold, and subjected to press molding to obtain a plate-shaped compacted powder article having a size of 55 mm (length)×10 mm (width)×5 mm (thickness) and a ring-shaped compacted powder article having an outer diameter of 35 mm, an inner diameter of 25 mm and a height of 5 mm. Then, the obtained compacted powder articles were sintered in a nitrogen atmosphere while maintaining the temperature at 600° C. for 30 minutes, thereby obtaining composite soft magnetic materials, which were plate-shaped sintered articles and ring-shaped sintered articles. With respect to the plate-shaped sintered articles, the resistivity was measured. The results are shown in Table 21. Further, coils were wound around the ring-shaped sintered articles, and the magnetic flux density, coercivity, iron loss at a magnetic flux density of 1.5 T and a frequency of 50 Hz, and iron loss at a magnetic flux density of 1.0 T and a frequency of 400 Hz were measured. The results are shown in Tables 21 to 23.

TABLE 21

| Type of method | | Composition of oxide-coated soft magnetic metal powder (% by mass) | | Properties of composite soft magnetic, sintered material produced from oxide-coated soft magnetic metal powder | | | | | |
|---|---|---|---|---|---|---|---|---|---|
| | | Oxide | Remainder | Density (g/cm3) | Magnetic flux density B10KA/m (T) | Coercivity (A/m) | Iron loss *4 (W/kg) | Iron loss *5 (W/kg) | Resistivity (μΩm) |
| Present invention | 1 | 0.1% SiO deposited⇒ 0.2% Mg deposited (*1) | Pure iron powder | 7.65 | 1.68 | 180 | 8.1 | 55 | 100 |
| Conventional method | | Silicone resin 0.14%, MgO powder (*) | Pure iron powder | 7.65 | 1.59 | 220 | 60 | 800 | 0.4 |
| Present invention | 2 | *1 | Fe—Al iron powder | 7.18 | 1.58 | 110 | 4.2 | 35 | 120 |
| Conventional method | | * | Fe—Al iron powder | 7.15 | 1.56 | 100 | 30 | 420 | 15 |
| Present invention | 3 | *1 | Fe—Ni iron powder | 7.91 | 1.15 | 120 | — | 40 | 130 |
| Conventional method | | * | Fe—Ni iron powder | 7.86 | 1.1 | 140 | — | 480 | 20 |
| Present invention | 4 | *1 | Fe—Cr iron powder | 7.64 | 1.25 | 180 | — | 48 | 110 |
| Conventional method | | * | Fe—Cr iron powder | 7.64 | 1.2 | 200 | — | 720 | 12 |
| Present invention | 5 | *1 | Fe—Si iron powder | 7.62 | 1.55 | 100 | 3.8 | 30 | 200 |
| Conventional method | | | Fe—Si iron powder | 7.63 | 1.53 | 120 | 30 | 400 | 15 |
| Present invention | 6 | *1 | Fe—Si—Al iron powder | 7.64 | 1.05 | 110 | — | 40 | 100 |
| Conventional method | | * | Fe—Si—Al iron powder | 7.63 | 1.01 | 140 | — | 500 | 20 |
| Present invention | 7 | *1 | Fe—Co—V iron powder | 7.65 | 1.95 | 180 | 6.2 | 50 | 100 |

TABLE 21-continued

| Type of method | Composition of oxide-coated soft magnetic metal powder (% by mass) Oxide | Remainder | Properties of composite soft magnetic, sintered material produced from oxide-coated soft magnetic metal powder: Density (g/cm3) | Magnetic flux density B10KA/m (T) | Coercivity (A/m) | Iron loss *4 (W/kg) | Iron loss *5 (W/kg) | Resistivity (μΩm) |
|---|---|---|---|---|---|---|---|---|
| Conventional method | * | Fe—Co—V iron powder | 7.65 | 1.92 | 220 | 60 | 780 | 12 |

*4: Iron loss as measured at a magnetic flux density of 1.5 T and a frequency of 50 Hz.

*5: Iron loss as measured at a magnetic flux density of 1.0 T and a frequency of 400 Hz.

TABLE 22

| Type of method | | Composition of oxide-coated soft magnetic metal powder (% by mass) Oxide | Remainder | Properties of composite soft magnetic, sintered material produced from oxide-coated soft magnetic metal powder: Density (g/cm3) | Magnetic flux density B10KA/m (T) | Coercivity (A/m) | Iron loss *4 (W/kg) | Iron loss *5 (W/kg) | Resistivity (μΩm) |
|---|---|---|---|---|---|---|---|---|---|
| Present invention | 1 | 0.1% SiO and 0.2% Mg simultaneously deposited (*2) | Pure iron powder | 7.65 | 1.69 | 165 | 7.8 | 49 | 110 |
| Conventional method | | 0.14% Silicone resin, 0.06% MgO powder (*) | Pure iron powder | 7.65 | 1.59 | 220 | 60 | 800 | 0.4 |
| Present invention | 2 | *2 | Fe—Al iron powder | 7.18 | 1.58 | 100 | 3.8 | 31 | 135 |
| Conventional method | | * | Fe—Al iron powder | 7.15 | 1.56 | 100 | 30 | 420 | 15 |
| Present invention | 3 | *2 | Fe—Ni iron powder | 7.91 | 1.15 | 105 | — | 36 | 140 |
| Conventional method | | * | Fe—Ni iron powder | 7.86 | 1.1 | 140 | — | 480 | 20 |
| Present invention | 4 | *2 | Fe—Cr iron powder | 7.64 | 1.25 | 162 | — | 44 | 122 |
| Conventional method | | * | Fe—Cr iron powder | 7.64 | 1.2 | 200 | — | 720 | 12 |
| Present invention | 5 | *2 | Fe—Si iron powder | 7.62 | 1.55 | 90 | 3.6 | 27 | 220 |
| Conventional method | | * | Fe—Si iron powder | 7.63 | 1.53 | 120 | 30 | 400 | 15 |
| Present invention | 6 | *2 | Fe—Si—Al iron powder | 7.64 | 1.05 | 100 | — | 36 | 110 |
| Conventional method | | * | Fe—Si—Al iron powder | 7.63 | 1.01 | 140 | — | 500 | 20 |
| Present invention | 7 | *2 | Fe—Co—V iron iron powder | 7.65 | 1.95 | 162 | 5.8 | 45 | 108 |
| Conventional method | | * | Fe—Co—V iron powder | 7.65 | 1.92 | 220 | 60 | 780 | 12 |

TABLE 23

| Type of method | | Composition of oxide-coated soft magnetic metal powder (% by mass) Oxide | Remainder | Properties of composite soft magnetic, sintered material produced from oxide-coated soft magnetic metal powder Density (g/cm3) | Magnetic flux density B10KA/m (T) | Coercivity (A/m) | Iron loss *4 (W/kg) | Iron loss *5 (W/kg) | Resistivity (μΩm) |
|---|---|---|---|---|---|---|---|---|---|
| Present invention | 1 | 0.2% MgO deposited⇒ 0.1% SiO deposited (*3) | Pure iron powder | 7.64 | 1.68 | 170 | 7.9 | 52 | 105 |
| Conventional method | | 0.14% Silicone resin, MgO powder (*) | Pure iron powder | 7.65 | 1.59 | 220 | 60 | 800 | 0.4 |
| Present invention | 2 | *3 | Fe—Al iron powder | 7.18 | 1.58 | 105 | 4 | 34 | 128 |
| Conventional method | | * | Fe—Al iron powder | 7.15 | 1.56 | 100 | 30 | 420 | 15 |
| Present invention | 3 | *3 | Fe—Ni iron powder | 7.91 | 1.15 | 113 | — | 38 | 136 |
| Conventional method | | * | Fe—Ni iron powder | 7.86 | 1.1 | 140 | — | 480 | 20 |
| Present invention | 4 | *3 | Fe—Cr iron powder | 7.64 | 1.25 | 172 | — | 46 | 115 |
| Conventional method | | * | Fe—Cr iron powder | 7.64 | 1.2 | 200 | — | 720 | 12 |
| Present invention | 5 | *3 | Fe—Si iron powder | 7.62 | 1.55 | 95 | 3.6 | 28 | 210 |
| Conventional method | | * | Fe—Si iron powder | 7.63 | 1.53 | 120 | 30 | 400 | 15 |
| Present invention | 6 | *3 | Fe—Si—Al iron powder | 7.64 | 1.05 | 105 | — | 38 | 105 |
| Conventional method | | * | Fe—Si—Al iron powder | 7.63 | 1.01 | 140 | — | 500 | 20 |
| Present invention | 7 | *3 | Fe—Co—V iron powder | 7.65 | 1.95 | 173 | 6 | 47 | 108 |
| Conventional method | | * | Fe—Co—V iron powder | 7.65 | 1.92 | 220 | 60 | 780 | 12 |

As can be seen from the results shown in Tables 21 to 23, although there is no substantial difference between the composite soft magnetic materials produced from soft magnetic powders coated with a Mg—Si-containing oxide film obtained in Examples 1 to 3 and the composite soft magnetic materials produced from soft magnetic powders coated with a Mg—Si-containing oxide film obtained in Conventional Example 1 with respect to density, it is apparent that the composite soft magnetic materials produced from soft magnetic powders coated with a Mg—Si-containing oxide film obtained in Examples 1 to 3 have high magnetic flux density, low coercivity, extremely high resistivity, as compared to the soft magnetic powders coated with a Mg—Si-containing oxide film obtained in Conventional Example 1, and hence, the composite soft magnetic materials produced from soft magnetic powders coated with a Mg—Si-containing oxide film obtained in Examples 1 to 3 exhibit extremely low iron loss, especially at high frequencies.

Example 14

As a raw powder material, an Fe—Si iron-based soft magnetic powder including 1% by mass of Si and the remainder containing Fe and inevitable impurities, and having an average particle diameter of 75 μm was prepared. Separately from the above, a pure Si powder having a particle diameter of not more than 1 μm and a Mg powder having an average particle diameter of 50 μm were prepared.

Firstly, a pure Si powder was added and mixed with an Fe—Si iron-based soft magnetic powder in an amount such that the Fe—Si iron-based soft magnetic powder:pure Si powder ratio became 99.5% by mass:0.5% by mass to obtain a mixed powder. The obtained mixed powder was heated in a hydrogen atmosphere at a temperature of 950° C. for 1 hour to form a high-concentration Si diffusion layer on a surface of the Fe—Si iron-based soft magnetic powder. Then, the resultant was maintained in air at a temperature of 250° C., thereby obtaining a surface-oxidized, Fe—Si iron-based soft magnetic raw powder material having an oxide layer formed on the high-concentration Si diffusion layer.

Subsequently, a Mg powder prepared in advance was added and mixed with the obtained surface-oxidized, Fe—Si iron-based soft magnetic raw powder material in an amount such that the surface-oxidized, Fe—Si iron-based soft magnetic raw powder material:Mg powder ratio became 99.8% by mass:0.2% by mass to obtain a mixed powder. Then, the obtained mixed powder was maintained at a temperature of 650° C., under a pressure of $2.7\times10^{-4}$ MPa, for 1 hour while tumbling, thereby obtaining an Fe—Si iron-based soft magnetic raw powder material of the present invention coated with a deposited oxide film including Mg, Si, Fe and O (hereafter, referred to as "present invention deposited oxide film-coated powder 1").

The thus obtained present invention deposited oxide film-coated Fe—Si iron-based soft magnetic raw powder material 1 was placed in a mold, and subjected to press molding to obtain a plate-shaped compacted powder article having a size of 55 mm (length)×10 mm (width)×5 mm (thickness) and a ring-shaped compacted powder article having an outer diameter of 35 mm, an inner diameter of 25 mm and a height of 5 mm. Then, the obtained compacted powder articles were sintered in a nitrogen atmosphere while maintaining the temperature at 500° C. for 30 minutes, thereby obtaining composite soft magnetic materials, which were a plate-shaped sintered article and ring-shaped sintered article. With respect to the plate-shaped sintered article, the resistivity was measured. The result is shown in Table 24. Further, a coil was wound around the ring-shaped sintered article, and the magnetic flux density, coercivity, iron loss at a magnetic flux density of 1.5 T and a frequency of 50 Hz, and iron loss at a magnetic flux density of 1.0 T and a frequency of 400 Hz were measured. The results are shown in Table 1.

Conventional Example 12

A Mg-containing oxide layer was chemically formed on a surface of an Fe—Si iron-based soft magnetic powder prepared in Example 14 to obtain a conventional Fe—Si iron-based soft magnetic powder coated with a Mg ferrite-containing oxide (hereafter, referred to as "conventional deposited oxide film-coated powder"). The obtained conventional deposited oxide film-coated powder was placed in a mold, and subjected to press molding to obtain a plate-shaped compacted powder article having a size of 55 mm (length)×10 mm (width)×5 mm (thickness) and a ring-shaped compacted powder article having an outer diameter of 35 mm, an inner diameter of 25 mm and a height of 5 mm. Then, the obtained compacted powder articles were sintered in a nitrogen atmosphere while maintaining the temperature at 500° C. for 30 minutes, thereby obtaining composite soft magnetic materials, which were a plate-shaped sintered article and ring-shaped sintered article. With respect to the plate-shaped sintered article, the resistivity was measured. The result is shown in Table 24. Further, a coil was wound around the ring-shaped sintered article, and the magnetic flux density, coercivity, iron loss at a magnetic flux density of 1.5 T and a frequency of 50 Hz, and iron loss at a magnetic flux density of 1.0 T and a frequency of 400 Hz were measured. The results are shown in Table 24.

TABLE 24

| Type of method | Properties of Mg—Si—Fe—O quaternary deposited oxide film: Thickness (nm) | Maximum crystal particle diameter (nm) | Properties of composite soft magnetic material: Density (g/cm$^3$) | Magnetic flux density B10KA/m (T) | Coercivity (A/m) | Iron loss* (W/kg) | Iron loss** (W/kg) | Resistivity (μΩm) |
|---|---|---|---|---|---|---|---|---|
| Example 14 | 100 | 30 | 7.6 | 1.57 | 90 | 23 | 20 | 1200 |
| Conventional example 12 | — | — | 7.4 | 1.50 | 145 | — | 58 | 35 |

*Iron loss as measured at a magnetic flux density of 1.5 T and a frequency of 50 Hz.
**Iron loss as measured at a magnetic flux density of 1.0 T and a frequency of 400 Hz.

As can be seen from the results shown in Table 24, although there is no substantial difference between the present invention deposited oxide film-coated powder 1 obtained in Example 14 and the composite soft magnetic material produced from the Fe—Si iron-based soft magnetic powder coated with a Mg-containing ferrite oxide obtained in Conventional Example 12 with respect to density, it is apparent that the composite soft magnetic material produced from present invention deposited oxide film-coated powder 1 obtained in Example 14 has high magnetic flux density, low coercivity, extremely high resistivity, as compared to the composite soft magnetic material produced from the Fe—Si iron-based soft magnetic powder coated with a Mg-containing ferrite oxide obtained in Conventional Example 12, and hence, the composite soft magnetic material produced from present invention deposited oxide film-coated powder 1 obtained in Example 14 exhibits extremely low iron loss, especially at high frequencies.

Example 15

Present methods 71 to 73 were performed as follows.

As raw powder materials, Fe—Si iron-based soft magnetic powders, each having a particle size indicated in Table 25 and a composition including 1% by mass of Si and the remainder containing Fe and inevitable impurities, were prepared. Separately from the above, a pure Si powder having a particle diameter of not more than 1 μm and a Mg powder having an average particle diameter of 50 μm were prepared.

A pure Si powder was added and mixed with each of the Fe—Si iron-based soft magnetic powders having different particle sizes in an amount such that the an Fe—Si iron-based soft magnetic powder: pure Si powder ratio became 97% by mass:2% by mass to obtain mixed powders. The obtained mixed powders were heated in a hydrogen atmosphere at a temperature of 950° C. for 1 hour to form a high-concentration Si diffusion layer on a surface of the Fe—Si iron-based soft magnetic powder. Then, the resultants were maintained in air at a temperature of 220° C., thereby obtaining surface-oxidized, Fe—Si iron-based soft magnetic raw powder materials having an oxide layer formed on the high-concentration Si diffusion layer.

Subsequently, a Mg powder prepared in advance was added and mixed with each of the obtained surface-oxidized, Fe—Si iron-based soft magnetic raw powder materials in an amount such that the surface-oxidized, Fe—Si iron-based soft magnetic raw powder material:Mg powder ratio became 99.8% by mass:0.2% by mass to obtain mixed powders. Then, the obtained mixed powders were maintained at a temperature of 650° C., under a pressure of $2.7\times10^{-4}$ MPa, for 1 hour while tumbling (hereafter, this step of adding and mixing a Mg powder with each of the obtained surface-oxidized, Fe—Si iron-based soft magnetic raw powder materials in an amount such that the surface-oxidized, Fe—Si iron-based soft magnetic raw powder material:Mg powder ratio became 99.8% by mass:0.2% by mass to obtain mixed powders, and maintaining the obtained mixed powder at a temperature of 650° C., under a pressure of $2.7\times10^{-4}$ MPa, for 1 hour while tumbling, is referred to as "Mg-coating treatment") to form a deposited oxide film including Mg, Si, Fe and O on a surface of the Fe—Si iron-based soft magnetic powders, thereby obtaining deposited oxide film-coated Fe—Si iron-based soft magnetic powders.

To each of the deposited oxide film-coated Fe—Si iron-based soft magnetic powders obtained by present methods 71 to 73, 2% by mass of a silicone resin was added and mixed to coat a surface of the deposited oxide film-coated Fe—Si iron-based soft magnetic powders with the silicone resin, thereby obtaining resin-coated composite powders. Then, each of the resin-coated composite powders was placed in a mold which had been heated to 120° C., and subjected to press molding to obtain a plate-shaped compacted powder article having a size of 55 mm (length)×10 mm (width)×5 mm (thickness) and a ring-shaped compacted powder article having an outer diameter of 35 mm, an inner diameter of 25 mm and a height of 5 mm. Then, the obtained compacted powder articles were sintered in a vacuum atmosphere while maintaining the temperature at 700° C. for 30 minutes, thereby obtaining composite soft magnetic materials, which were plate-shaped sintered articles and ring-shaped sintered articles. With respect to the plate-shaped sintered articles, the resistivity was measured. The results are shown in Table 2. Further, coils were wound around the ring-shaped sintered articles, and the magnetic flux density, coercivity, and iron loss at a magnetic flux density of 0.1 T and a frequency of 20 Hz were measured. The results are shown in Table 25.

Conventional Example 13

Conventional method 11 was performed as follows.

As a raw powder material, an Fe—Si iron-based soft magnetic powder having a particle size indicated in Table 25 and a composition including 1% by mass of Si and the remainder containing Fe and inevitable impurities was prepared. Then, without subjecting the Fe—Si iron-based soft magnetic powder to Mg-coating treatment, 2% by mass of a silicone resin was added and mixed with the Fe—Si iron-based soft magnetic powder to coat a surface of the Fe—Si iron-based soft magnetic powder with the silicone resin, thereby obtaining a resin-coated composite powder. Subsequently, the resin-coated composite powder was placed in a mold which had been heated to 120° C., and subjected to press molding to obtain a plate-shaped compacted powder article having a size of 55 mm (length)×10 mm (width)×5 mm (thickness) and a ring-shaped compacted powder article having an outer diameter of 35 mm, an inner diameter of 25 mm and a height of 5 mm. Then, the obtained compacted powder articles were sintered in a vacuum atmosphere while maintaining the temperature at 700° C. for 30 minutes, thereby obtaining composite soft magnetic materials, which were a plate-shaped sintered article and a ring-shaped sintered article. With respect to the plate-shaped sintered article, the resistivity was measured. The result is shown in Table 25. Further, a coil was wound around the ring-shaped sintered article, and the magnetic flux density, coercivity, and iron loss at a magnetic flux density of 0.1 T and a frequency of 20 Hz were measured. The results are shown in Table 25.

TABLE 25

| Type of method | | Average particle diameter of Fe—1% Si raw powder material (μm) | Mg-coating treatment | Magnetic properties: Magnetic flux density $B_{10KA/m}$ (T) | Coercivity (A/m) | Iron loss* (W/kg) | Resistivity (μΩm) |
|---|---|---|---|---|---|---|---|
| Present method | 71 | 60 | treated | 1.30 | 95 | 46 | 25000 |
| | 72 | 150 | treated | 1.32 | 90 | 41 | 24000 |
| | 73 | 300 | treated | 1.35 | 80 | 39 | 20000 |
| Conventional method 11 | | 150 | not treated | 1.32 | 130 | 9700 | 150 |

Iron loss* as measured at a magnetic flux density of 0.1 T and a frequency of 20 kHz.

As can be seen from the results shown in Table 25, it is apparent that the composite soft magnetic materials produced by present methods 71 to 73 have high magnetic flux density, low coercivity, and extremely high resistivity, as compared to the composite soft magnetic material produced by conventional method 11, and hence, the composite soft magnetic materials produced by present methods 71 to 73 exhibit extremely low iron loss, especially at high frequencies.

Example 16

Present methods 74 to 76 were performed as follows.

As raw powder materials, Fe—Si iron-based soft magnetic powders, each having a particle size indicated in Table 26 and a composition including 3% by mass of Si and the remainder containing Fe and inevitable impurities, were prepared. Separately from the above, a pure Si powder having a particle diameter of not more than 1 μm and an Mg powder having an average particle diameter of 50 pan were prepared.

A pure Si powder was added and mixed with each of the Fe—Si iron-based soft magnetic powders having different particle sizes in an amount such that the Fe—Si iron-based soft magnetic powder: pure Si powder ratio became 99.5% by mass:0.5% by mass to obtain mixed powders. The obtained mixed powders were heated in a hydrogen atmosphere at a temperature of 950° C. for 1 hour to form a high-concentration Si diffusion layer on a surface of the Fe—Si iron-based soft magnetic powder. Then, the resultants were maintained in air at a temperature of 220° C., thereby obtaining surface-oxidized, Fe—Si iron-based soft magnetic raw powder materials having an oxide layer formed on the high-concentration Si diffusion layer.

The surface-oxidized, Fe—Si iron-based soft magnetic raw powder materials were subjected to Mg-coating treatment to form a deposited oxide film including Mg, Si, Fe and O on a surface of the Fe—Si iron-based soft magnetic powders, thereby obtaining deposited oxide film-coated Fe—Si iron-based soft magnetic powders.

To each of the deposited oxide film-coated Fe—Si iron-based soft magnetic powders obtained by present methods 74 to 76, 2% by mass of a silicone resin was added and mixed to coat a surface of the deposited oxide film-coated Fe—Si iron-based soft magnetic powders with the silicone resin, thereby obtaining resin-coated composite powders. Then, each of the resin-coated composite powders was placed in a mold which had been heated to 120° C., and subjected to press molding to obtain a plate-shaped compacted powder article having a size of 55 mm (length)×10 mm (width)×5 mm (thickness) and a ring-shaped compacted powder article having an outer diameter of 35 mm, an inner diameter of 25 mm and a height of 5 mm. Then, the obtained compacted powder articles were sintered in a vacuum atmosphere while maintaining the temperature at 700° C. for 30 minutes, thereby obtaining composite soft magnetic materials, which were plate-shaped sintered articles and ring-shaped sintered articles. With respect to the plate-shaped sintered articles, the resistivity was measured. The results are shown in Table 3. Further, coils were wound around the ring-shaped sintered articles, and the magnetic flux density, coercivity, and iron loss at a magnetic flux density of 0.1 T and a frequency of 20 Hz were measured. The results are shown in Table 26.

Conventional Example 14

Conventional method 12 was performed as follows.

As a raw powder material, an Fe—Si iron-based soft magnetic powder having a particle size indicated in Table 26 and a composition including 1% by mass of Si and the remainder containing Fe and inevitable impurities was prepared. Then, without subjecting the Fe—Si iron-based soft magnetic powder to Mg-coating treatment, 2% by mass of a silicone resin was added and mixed with the Fe—Si iron-based soft magnetic powder to coat a surface of the Fe—Si iron-based soft magnetic powder with the silicone resin, thereby obtaining a resin-coated composite powder. Subsequently, the resin-coated composite powder was placed in a mold which had been heated to 120° C., and subjected to press molding to obtain a plate-shaped compacted powder article having a size of 55 mm (length)×10 mm (width)×5 mm (thickness) and a ring-shaped compacted powder article having an outer diameter of 35 mm, an inner diameter of 25 mm and a height of 5 mm. Then, the obtained compacted powder articles were sintered in a vacuum atmosphere while maintaining the temperature at 700° C. for 30 minutes, thereby obtaining composite soft magnetic materials, which were a plate-shaped sintered article and a ring-shaped sintered article. With respect to the plate-shaped sintered article, the resistivity was measured. The result is shown in Table 25. Further, a coil was wound around the ring-shaped sintered article, and the magnetic flux density, coercivity, and iron loss at a magnetic flux density of 0.1 T and a frequency of 20 Hz were measured. The results are shown in Table 26.

TABLE 26

| Type of method | | Average particle diameter of Fe—1% Si raw powder material (μm) | Mg-coating treatment | Magnetic properties: Magnetic flux density $B_{10KA/m}$ (T) | Coercivity (A/m) | Iron loss* (W/kg) | Resistivity (μΩm) |
|---|---|---|---|---|---|---|---|
| Present method | 74 | 60 | treated | 1.42 | 100 | 55 | 21000 |
| | 75 | 150 | treated | 1.43 | 97 | 52 | 20000 |
| | 76 | 300 | treated | 1.47 | 83 | 47 | 17000 |
| Conventional method 12 | | 150 | not treated | 1.43 | 140 | 9900 | 150 |

Iron loss* as measured at a magnetic flux density of 0.1 T and a frequency of 20 kHz.

As can be seen from the results shown in Table 26, it is apparent that the composite soft magnetic materials produced by present methods 74 to 76 have high magnetic flux density, low coercivity, and extremely high resistivity, as compared to the composite soft magnetic material produced by conventional method 12, and hence, the composite soft magnetic materials produced by present methods 74 to 76 exhibit extremely low iron loss, especially at high frequencies.

Example 17

Present methods 77 to 79 were performed as follows.

As raw powder materials, Fe powders having particle sizes indicated in Table 27 were prepared. Separately from the above, a pure Si powder having a particle diameter of not more than 1 μm and a Mg powder having an average particle diameter of 50 μm were prepared.

A pure Si powder was added and mixed with each of the Fe powders having different particle sizes in an amount such that the Fe powder:pure Si powder ratio became 97% by mass:3% by mass to obtain mixed powders. The obtained mixed powders were heated in a hydrogen atmosphere at a temperature of 950° C. for 1 hour to form a high-concentration Si diffusion layer on a surface of the Fe—Si iron-based soft magnetic powder. Then, the resultants were maintained in air at a temperature of 220° C., thereby obtaining surface-oxidized, Fe—Si iron-based soft magnetic raw powder materials having an oxide layer formed on the high-concentration Si diffusion layer.

The surface-oxidized, Fe—Si iron-based soft magnetic raw powder materials were subjected to Mg-coating treatment to form a deposited oxide film including Mg, Si, Fe and O on a surface of the Fe—Si iron-based soft magnetic powders, thereby obtaining deposited oxide film-coated Fe—Si iron-based soft magnetic powders.

To each of the deposited oxide film-coated Fe—Si iron-based soft magnetic powders obtained by present methods 77 to 79, 2% by mass of a silicone resin was added and mixed to coat a surface of the deposited oxide film-coated Fe—Si iron-based soft magnetic powders with the silicone resin, thereby obtaining resin-coated composite powders. Then, each of the resin-coated composite powders was placed in a mold which had been heated to 120° C., and subjected to press molding to obtain a plate-shaped compacted powder article having a size of 55 mm (length)×10 mm (width)×5 mm (thickness), a ring-shaped compacted powder article having an outer diameter of 35 mm, an inner diameter of 25 mm and a height of 5 mm, and a ring-shaped compacted powder article having an outer diameter of 50 mm, an inner diameter of 25 mm and a height of 25 mm. Then, the obtained compacted powder articles were sintered in a vacuum atmosphere while maintaining the temperature at 700° C. for 30 minutes, thereby obtaining composite soft magnetic materials, which were plate-shaped sintered articles and ring-shaped sintered articles. With respect to the plate-shaped sintered articles, the resistivity was measured. The results are shown in Table 27.

Further, coils were wound around the ring-shaped sintered articles having smaller diameter, and the magnetic flux density, coercivity, and iron loss at a magnetic flux density of 0.1 T and a frequency of 20 Hz were measured. The results are shown in Table 27.

Furthermore, with respect to the ring-shaped sintered articles having smaller diameter, inductance at 20 kHz with a DC bias current of 20 A was measured, and the magnetic permeability of the alternating current was calculated. The results are shown in Table 28. On the other hand, coils were wound around the ring-shaped sintered articles having larger diameter to obtain a reactor having a substantially constant inductance. The reactor was connected to a typical switching power supply equipped with an active filter, and the efficiency of output electric power (%) at an input electric power of 1,000 W and 1,500 W was measured. The results are shown in Table 28.

Conventional Example 15

Conventional method 13 was performed as follows.

As a raw powder material, an Fe powder having a particle size indicated in Table 4 was prepared. Then, without subjecting the Fe powder to Mg-coating treatment, 2% by mass of a silicone resin was added and mixed with the Fe powder to coat a surface of the Fe powder with the silicone resin, thereby obtaining a resin-coated composite powder. Subsequently, the resin-coated composite powder was placed in a mold which had been heated to 120° C., and subjected to press molding to obtain a plate-shaped compacted powder article having a size of 55 mm (length)×10 mm (width)×5 mm (thickness), a ring-shaped compacted powder article having an outer diameter of 35 mm, an inner diameter of 25 mm and a height of 5 mm, and a ring-shaped compacted powder article having an outer diameter of 50 mm, an inner diameter of 25 mm and a height of 25 mm. Then, the obtained compacted powder articles were sintered in a vacuum atmosphere while maintaining the temperature at 700° C. for 30 minutes, thereby obtaining composite soft magnetic materials, which were plate-shaped sintered articles and ring-shaped sintered articles. With respect to the plate-shaped sintered articles, the resistivity was measured. The results are shown in Table 27. Further, coils were wound around the ring-shaped sintered articles having smaller diameter, and the magnetic flux density, coercivity, and iron loss at a magnetic flux density of 0.1 T and a frequency of 20 Hz were measured. The results are shown in Table 27.

Furthermore, with respect to the ring-shaped sintered articles having smaller diameter, inductance at 20 kHz with a DC bias current of 20 A was measured, and the magnetic permeability of the alternating current was calculated. The results are shown in Table 28. On the other hand, coils were wound around the ring-shaped sintered articles having larger diameter to obtain a reactor having a substantially constant inductance. The reactor was connected to a typical switching power supply equipped with an active filter, and the efficiency of output electric power (%) at an input electric power of 1,000 W and 1,500 W was measured. The results are shown in Table 28.

TABLE 27

| Type of method | | Average particle diameter of Fe raw powder material (μm) | Mg-coating treatment | Magnetic properties: Magnetic flux density $B_{10KA/m}$ (T) | Coercivity (A/m) | Iron loss* (W/kg) | Resistivity (μΩm) |
|---|---|---|---|---|---|---|---|
| Present method | 77 | 80 | treated | 1.50 | 115 | 62 | 18000 |
| | 78 | 150 | treated | 1.52 | 100 | 68 | 15000 |
| | 79 | 300 | treated | 1.55 | 90 | 75 | 12000 |
| Conventional method 13 | | 150 | not treated | 1.51 | 150 | 1000 | 80 |

Iron loss* as measured at a magnetic flux density of 0.1 T and a frequency of 20 kHz.

TABLE 28

| Type of method | Magnetic flux density B10K (T) | Coercivity (A/m) | Iron loss W1/10k (W/kg) | Magnetic permeability 20 A 20 kHz | Switching power supply: Input electric power (W) | Efficiency (%) |
|---|---|---|---|---|---|---|
| Example 18 | 1.55 | 90 | 17 | 32 | 1000 | 92.7 |
| | | | | | 1500 | 91.9 |
| Conventional example 16 | 1.51 | 150 | 30 | 28 | 1000 | 89.0 |
| | | | | | 1500 | 88.0 |

As can be seen from the results shown in Tables 27 and 28, it is apparent that the composite soft magnetic materials produced by present methods 77 to 79 have high magnetic flux density, low coercivity, and extremely high resistivity, as compared to the composite soft magnetic material produced by conventional method 13, and hence, the composite soft magnetic materials produced by present methods 77 to 79 exhibit extremely low iron loss, especially at high frequencies.

INDUSTRIAL APPLICABILITY

A composite soft magnetic material having high resistivity, which is produced from a soft magnetic powder coated with a Mg-containing oxide film obtained by the method of the present invention, exhibits high magnetic flux density and low iron loss at high frequencies, so that it can be advantageously used as a material for various electromagnet circuit components. Examples of electromagnet circuit components include a magnetic core, motor core, generator core, solenoid core, ignition core, reactor core, transcore, choke coil core and magnetic sensor core. Further, examples of electric appliances in which such electromagnet circuit components may be integrated include a motor, generator, solenoid, injector, electromagnetic driving valve, inverter, converter, transformer, relay, and magnetic sensor system. Thus, the present invention enables improvement of performance and efficiency of electric appliances, as well as miniaturization of electric appliances.

As mentioned above, by using a soft magnetic metal powder coated with a Mg-containing oxide film obtained by the method of the present invention, it becomes possible to produce a composite soft magnetic material having excellent properties with respect to resistivity and mechanical strength at low cost. Therefore, the present invention is advantageous in the electric and electronic industry.

According to the present invention, in which a SiO powder is used as a raw material, a soft magnetic powder coated with a Mg—Si-containing oxide can be produced easily at low cost, so that a composite soft magnetic material having excellent properties with respect to resistivity and mechanical strength can be produced from the soft magnetic powder coated with a Mg—Si-containing oxide at low cost. Further, such a composite soft magnetic material exhibits high magnetic flux density and low iron loss at high frequencies, so that it can be advantageously used as a material for various electromagnet circuit components. Examples of electromagnet circuit components include a magnetic core, motor core, generator core, solenoid core, ignition core, reactor core, transcore, choke coil core and magnetic sensor core. Further, examples of electric appliances in which such electromagnet circuit components may be integrated include a motor, generator, solenoid, injector, electromagnetic driving valve, inverter, converter, transformer, relay, and magnetic sensor system. Thus, the present invention enables improvement of performance and efficiency of electric appliances, as well as miniaturization of electric appliances.

The invention claimed is:

1. A method for producing a soft magnetic metal powder coated with a Mg-containing oxide film used for producing a composite soft magnetic material having a resistivity of 65 μΩm or more, comprising the steps of:

subjecting a soft magnetic metal powder having an average particle diameter in the range of 5 to 500 μm to oxidation treatment to provide a raw powder material;

adding and mixing a Mg powder with said raw powder material to obtain a mixed powder; the amount of the Mg powder being 0.05 to 2% by mass of the mass of the soft magnetic metal which has been subjected to oxidation treatment, and heating said mixed powder while tumbling at a temperature of 150 to 1,100° C. in an inert gas or vacuum atmosphere under a pressure of $1\times10^{-12}$ to $1\times10^{-1}$ MPa, thereby obtaining a soft magnetic metal powder coated with Mg-containing oxide film, wherein said soft magnetic metal powder is an iron powder, an insulated-iron powder, Fe—Al iron-based soft magnetic alloy powder, Fe—Ni iron based soft magnetic alloy powder, Fe—Cr iron-based soft magnetic alloy powder, Fe—Si iron-based soft magnetic alloy powder, Fe—Si—Al iron based soft magnetic alloy powder, Fe—Co iron-based soft magnetic alloy powder, Fe—Co—V iron-based soft magnetic alloy powder, or Fe—P iron-based soft magnetic alloy powder, and wherein said soft magnetic metal powder is used for producing a composite soft magnetic material having resistivity of 65 μΩm or more.

2. The method according to claim 1, further comprising the step of heating said soft magnetic metal powder coated with a Mg-containing oxide film in an oxidizing atmosphere at a temperature of 50 to 400° C.

3. The method according to claim 1, wherein said step of subjecting a soft magnetic metal powder to oxidation treatment comprises heating a soft magnetic metal powder in an oxidizing atmosphere at a temperature of 50 to 500° C.

4. A method for producing a raw powder material defined in claim 1 comprising a soft magnetic powder which has been subjected to oxidation treatment, which comprises the steps of:

adding and mixing a Si powder with an Fe—Si iron-based soft magnetic powder or Fe powder, followed by heating in a non-oxidizing atmosphere to obtain an Fe—Si iron-based soft magnetic powder having a high-concentration Si diffusion layer which has a Si concentration higher than the Fe—Si iron-based soft magnetic powder or Fe powder;

and subjecting said Fe—Si iron-based soft magnetic powder having a high-concentration Si diffusion layer to oxidizing treatment, thereby obtaining a surface-oxidized, Fe—Si iron-based soft magnetic raw powder material having an oxide layer formed on the high-concentration Si diffusion layer.

5. A method for producing a soft magnetic metal powder coated with a Mg-containing oxide film used for producing a composite soft magnetic material having resistivity of 65 μΩm or more, comprising the steps of:

adding and mixing a Mg powder with a soft magnetic metal powder having an average particle diameter in the range of 5 to 500 μm to obtain a mixed powder; the amount of the Mg powder being 0.05 to 2% by mass of the mass of the soft magnetic metal, and heating said mixed powder at a temperature of 150 to 1,100° C. in an inert gas or vacuum atmosphere under a pressure of $1\times10^{-12}$ to $1\times10^{-1}$ MPa, followed by heating said mixed powder in an oxidizing atmosphere at a temperature of 50 to 400° C. to effect oxidation treatment, thereby obtaining a soft magnetic metal powder coated with a Mg-containing oxide film, wherein said soft magnetic metal powder is an iron powder, an insulated-iron powder, Fe—Al iron-based soft magnetic alloy powder, Fe—Ni iron-based soft magnetic alloy powder, Fe—Cr iron-based soft magnetic alloy powder, Fe—Si iron-based soft magnetic alloy powder, Fe—Si—Al iron-based soft magnetic alloy powder, Fe—Co iron-based soft magnetic alloy powder, Fe—Co—V iron-based soft magnetic alloy powder, or Fe—P iron-based soft magnetic alloy powder, and wherein said soft magnetic metal powder is used for producing a composite soft magnetic material having resistivity of 65 μΩm or more.

6. The method according to claim 5, further comprising the steps of:

adding and mixing a Si powder with an Fe—Si iron-based soft magnetic powder or a Fe powder to produce a mixture, heating the mixture in a non-oxidizing atmosphere to obtain an Fe—Si iron-based soft magnetic powder having a high-concentration Si diffusion layer which has a Si concentration higher than that in the Fe—Si iron-based soft magnetic powder or the Fe powder; and subjecting said Fe—Si iron-based soft magnetic metal powder having a high-concentration Si diffusion layer to the oxidizing treatment in the step of subjecting, thereby obtaining a surface-oxidized, Fe—Si iron-based soft magnetic raw powder material having an oxide layer formed on the high-concentration Si diffusion layer as the raw powder material.

* * * * *